US011776447B2

(12) United States Patent
Kim

(10) Patent No.: US 11,776,447 B2
(45) **Date of Patent: *Oct. 3, 2023**

(54) DISPLAY DEVICE, DATA DRIVING CIRCUIT AND DISPLAY PANEL

(71) Applicant: LG DISPLAY CO., LTD., Seoul (KR)

(72) Inventor: Jihun Kim, Seoul (KR)

(73) Assignee: LG DISPLAY CO., LTD., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/690,808

(22) Filed: Mar. 9, 2022

(65) Prior Publication Data

US 2022/0198985 A1 Jun. 23, 2022

Related U.S. Application Data

(63) Continuation of application No. 17/342,920, filed on Jun. 9, 2021, now Pat. No. 11,302,237.

(30) Foreign Application Priority Data

Jun. 23, 2020 (KR) ..... 10-2020-0076292

(51) Int. Cl.
*G09G 3/20* (2006.01)
*G09G 3/3291* (2016.01)
*G09G 3/3266* (2016.01)

(52) U.S. Cl.
CPC ..... *G09G 3/2003* (2013.01); *G09G 3/3266* (2013.01); *G09G 3/3291* (2013.01);
(Continued)

(58) Field of Classification Search
CPC ... G09G 2300/0452; G09G 2300/0426; G09G 3/3648; G09G 3/3614; G09G 3/3607;
(Continued)

(56) References Cited

U.S. PATENT DOCUMENTS

2009/0262056 A1 10/2009 Yang et al.
2014/0118657 A1* 5/2014 Duan ..... G09G 3/364 257/59

(Continued)

FOREIGN PATENT DOCUMENTS

CN 102800276 A 11/2012
CN 103880829 A 6/2014

(Continued)

*Primary Examiner* — Dong Hui Liang
(74) *Attorney, Agent, or Firm* — Birch, Stewart, Kolasch Birch, LLP

(57) ABSTRACT

A display device includes a display panel in which a plurality of pixels including first, second, and third subpixels disposed in a region where a plurality of gate lines extending in a first direction and a plurality of data lines extending in a second direction intersect. The display device further includes a gate driving circuit configured to drive the plurality of gate lines, a data driving circuit configured to drive the plurality of data lines, and a timing controller configured to control the gate driving circuit and the data driving circuit. In the display panel, a first data voltage is applied to the first subpixel, and a second data voltage is applied to the second subpixels or the third subpixels.

17 Claims, 17 Drawing Sheets

(52) U.S. Cl.
CPC . *G09G 2300/0452* (2013.01); *G09G 2310/08* (2013.01); *G09G 2360/02* (2013.01)

(58) Field of Classification Search
CPC ..... G09G 3/2003; G09G 3/3688; G09G 3/36; G09G 3/3611; G09G 3/3677; G09G 3/3208; G09G 3/20; G09G 2310/0297; G09G 2310/08; G09G 2340/06
See application file for complete search history.

(56) References Cited

U.S. PATENT DOCUMENTS

| | | | | |
|---|---|---|---|---|
| 2015/0116375 | A1* | 4/2015 | Yang | H01L 27/3216 345/77 |
| 2017/0061925 | A1 | 3/2017 | Kim et al. | |
| 2020/0372870 | A1* | 11/2020 | Chen | G09G 3/3688 |
| 2020/0394959 | A1 | 12/2020 | Lou et al. | |

FOREIGN PATENT DOCUMENTS

| | | | |
|---|---|---|---|
| CN | 104597611 | A | 5/2015 |
| CN | 105118431 | A | 12/2015 |
| CN | 105739140 | A | 7/2016 |
| CN | 110718178 | A | 1/2020 |
| CN | 110808013 | A | 2/2020 |
| KR | 10-2013-0105532 | A | 9/2013 |
| TW | 201835884 | A | 10/2018 |

* cited by examiner

Image Source

| | | | |
|---|---|---|---|
| $Y_{11}$ $Cb_{11}$ $Cr_{11}$ | $Y_{12}$ $Cb_{11}$ $Cr_{11}$ | $Y_{13}$ $Cb_{13}$ $Cr_{13}$ | $Y_{14}$ $Cb_{13}$ $Cr_{13}$ |
| $Y_{21}$ $Cb_{21}$ $Cr_{21}$ | $Y_{22}$ $Cb_{21}$ $Cr_{21}$ | $Y_{23}$ $Cb_{23}$ $Cr_{23}$ | $Y_{24}$ $Cb_{23}$ $Cr_{23}$ |

RGB Image Data

| | | | |
|---|---|---|---|
| $R_{11}$ $G_{11}$ $B_{11}$ | $R_{12}$ $G_{12}$ $B_{12}$ | $R_{13}$ $G_{13}$ $B_{13}$ | $R_{14}$ $G_{14}$ $B_{14}$ |
| $R_{21}$ $G_{21}$ $B_{21}$ | $R_{22}$ $G_{22}$ $B_{22}$ | $R_{23}$ $G_{23}$ $B_{23}$ | $R_{24}$ $G_{24}$ $B_{24}$ |

WRGB Image Data

| | | | |
|---|---|---|---|
| $W_{11}$ $R_{11}$ $G_{11}$ $B_{11}$ | $W_{12}$ $R_{11}$ $G_{11}$ $B_{11}$ | $W_{13}$ $R_{13}$ $G_{13}$ $B_{13}$ | $W_{14}$ $R_{13}$ $G_{13}$ $B_{13}$ |
| $W_{21}$ $R_{21}$ $G_{21}$ $B_{21}$ | $W_{22}$ $R_{21}$ $G_{21}$ $B_{21}$ | $W_{23}$ $R_{23}$ $G_{23}$ $B_{23}$ | $W_{24}$ $R_{23}$ $G_{23}$ $B_{23}$ |

(a)

(b)

Image Source

| | | | |
|---|---|---|---|
| $Y_{11}$ $Cb_{11}$ $Cr_{11}$ | $Y_{12}$ $Cb_{11}$ $Cr_{11}$ | $Y_{13}$ $Cb_{13}$ $Cr_{13}$ | $Y_{14}$ $Cb_{13}$ $Cr_{13}$ |
| $Y_{21}$ $Cb_{11}$ $Cr_{11}$ | $Y_{22}$ $Cb_{11}$ $Cr_{11}$ | $Y_{23}$ $Cb_{13}$ $Cr_{13}$ | $Y_{24}$ $Cb_{13}$ $Cr_{13}$ |

RGB Image Data

| | | | |
|---|---|---|---|
| $R_{11}$ $G_{11}$ $B_{11}$ | $R_{12}$ $G_{12}$ $B_{12}$ | $R_{13}$ $G_{13}$ $B_{13}$ | $R_{14}$ $G_{14}$ $B_{14}$ |
| $R_{21}$ $G_{21}$ $B_{21}$ | $R_{22}$ $G_{22}$ $B_{22}$ | $R_{23}$ $G_{23}$ $B_{23}$ | $R_{24}$ $G_{24}$ $B_{24}$ |

WRGB Image Data

| | | | |
|---|---|---|---|
| $W_{11}$ $R_{11}$ $G_{11}$ $B_{11}$ | $W_{12}$ $R_{11}$ $G_{11}$ $B_{11}$ | $W_{13}$ $R_{13}$ $G_{13}$ $B_{13}$ | $W_{14}$ $R_{13}$ $G_{13}$ $B_{13}$ |
| $W_{21}$ $R_{11}$ $G_{11}$ $B_{11}$ | $W_{22}$ $R_{11}$ $G_{11}$ $B_{11}$ | $W_{23}$ $R_{13}$ $G_{13}$ $B_{13}$ | $W_{24}$ $R_{13}$ $G_{13}$ $B_{13}$ |

DISPLAY DEVICE, DATA DRIVING CIRCUIT AND DISPLAY PANEL

CROSS REFERENCE TO RELATED APPLICATION

This application is a Continuation of U.S. patent application Ser. No. 17/342,920, filed on Jun. 9, 2021, which claims priority to Korean Patent Application No. 10-2020-0076292, filed in the Republic of Korea on Jun. 23, 2020, the entire contents of all these applications are hereby expressly incorporated by reference into the present application.

BACKGROUND OF THE INVENTION

1. Field of the Invention

The present disclosure relates to a display device, a data driving circuit and a display panel.

2. Description of the Background Art

As the information society develops, the demand for display devices for displaying images is increasing in various forms. Various types of display devices such as a liquid crystal display device (LCD), and an organic light emitting display device (OLED) have been used for this purpose.

The image data input to the display device can be RGB image data including red data (R), green data (G), and blue data (B), or YCbCr including luminance data (Y) and color difference data (Cb, Cr). Here, the Cb data represents the difference (Y−B) between the luminance data (Y) and the blue data (B), and the Cr data represents the difference (Y−R) between the luminance data (Y) and the red data (R).

In the case that the display device includes WRGB subpixels including white (W) subpixels, red (R) subpixels, green (G) subpixels, and blue (B) subpixels, the display device converts input RGB image data or YCbCr image data into WRGB format and displays an image.

In this case, while RGB image data supports a 4:4:4 format in which all color components have the same sampling ratio, the YCbCr image data supports formats such as 4:4:4, 4:2:2, and 4:2:0 depending on the sampling ratio of the color difference component.

For example, YCbCr image data used for TV broadcasts, sports broadcasts, movies, etc. are formed in a 4:2:0 format, YCbCr image data used in games are formed in various formats of 4:4:4, 4:2:2, and 4:2:0, and YCbCr image data used in a computer can be formed in a 4:4:4 format.

Accordingly, a display device having a WRGB pixel structure, particularly a WRGB display device, needs to convert and display the received YCbCr image data according to the WRGB pixel structure.

SUMMARY OF THE INVENTION

Embodiments of the present disclosure can provide a display device, a data driving circuit, and a display panel capable of displaying YCbCr image data as WRGB image data.

In addition, embodiments of the present disclosure can provide a display device, a data driving circuit, and a display panel capable of displaying YCbCr image data as WRGB image data while simplifying the structure of a driving circuit.

In addition, embodiments of the present disclosure can provide a display device, a data driving circuit, and a display panel capable of displaying YCbCr image data as WRGB image data by changing the structure of the display panel.

In addition, embodiments of the present disclosure can provide a display device, a data driving circuit, and a display panel capable of changing a driving method according to a format of received image data.

In one aspect, embodiments of the present disclosure can provide a display device including a display panel in which pixels including a white subpixel and a colored subpixel are arranged in a matrix form and subpixels are disposed in a region where a plurality of gate lines extending in a first direction and a plurality of data lines extending in a second direction intersect, a gate driving circuit driving the plurality of gate lines, a data driving circuit driving the plurality of data lines, and a timing controller for controlling the gate driving circuit and the data driving circuit, wherein, in the display panel, luminance data voltage is applied to the white subpixel and a same data voltage is applied to two colored subpixels adjacent in the first direction.

In an aspect, there can be provided with a display device in which the colored subpixel including a red subpixel, a green subpixel, and a blue subpixel.

In an aspect, there can be provided with a display device in which the timing controller converts YCbCr image data of 4:2:2 format, YCbCr image data of 4:2:0 format, YCbCr image data of 4:4:4 format or RGB image data into image data for display.

In an aspect, there can be provided with a display device in which the data driving circuit includes a plurality of first latch circuits for receiving image data transmitted from the timing controller and a second latch circuit for receiving image data from the first latch circuit at a specified timing, and the second latch circuit corresponding to the white subpixel is connected in a 1:1 manner to the first latch circuit, and two second latch circuits corresponding to two adjacent colored subpixels corresponding with the same color in the first direction are connected to one of the first latch circuits.

In an aspect, there can be provided with a display device in which the display panel connects two colored subpixels adjacent in the first direction to one data pad.

In an aspect, there can be provided with a display device in which the display panel includes a first switch transferring image data transmitted from the data pad to an odd-numbered pixel, and a second switch transferring image data transmitted from the data pad to an even-numbered pixel.

In an aspect, there can be provided with a display device in which, in the display panel, two gate lines are arranged in one row in which the pixels are arranged, and two pixels adjacent to each other in the first direction are independently controlled through the two gate lines.

In an aspect, there can be provided with a display device in which turn-on and turn-off signals are applied to the two gate lines at the same time when image data of 4:2:2 format is received, and turn-on signals are alternately applied to the two gate lines when image data of 4:4:4 format is received.

In an aspect, there can be provided with a display device in which the data driving circuit sets a driving frequency of the display panel to a first frequency when image data of 4:2:2 format is received, and the data driving circuit, when image data of 4:4:4 format is received, changes the driving frequency of the display panel to a second frequency lower than the first frequency and alternately transmits the image data to two adjacent colored subpixels displaying the same color in the first direction in one clock period of the second frequency.

In an aspect, there can be provided with a display device in which the colored subpixel is composed of dual subpixels corresponding to the sizes of two white subpixels arranged in the second direction, and two dual subpixels adjacent in the first direction are connected to one data line.

In an aspect, there can be provided with a display device in which, in the display panel, a first scan signal and a second scan signal are applied based on the two white subpixels, a switching transistor is disposed so that the first scan signal and the second scan signal are alternately applied to the dual subpixels arranged in the first direction, and the first scan signal and the second scan signal are simultaneously turned on and turned off with a time interval of two horizontal periods.

In an aspect, there can be provided with a display device in which, in the display panel, a first scan signal and a second scan signal are applied based on the two white subpixels, a switching transistor is disposed so that the corresponding white subpixel and the dual subpixel in a first pixel are simultaneously turned on by the first scan signal, a switching transistor is disposed so that the corresponding white subpixel and the dual subpixel in a second pixel adjacent in the first direction are simultaneously turned on by the second scan signal, and the first scan signal and the second scan signal are alternately turned on and turned off.

In an aspect, there can be provided with a display device in which the colored subpixel is composed of dual subpixels corresponding to the sizes of two white subpixels arranged in the second direction, two adjacent dual subpixels with the same color and two adjacent dual subpixels with different colors in the first direction are connected to one dual data pad, and the display panel further includes a first switch for transferring image data transmitted from the dual data pad to dual subpixels of a first color, and a second switch for transferring image data transmitted from the dual data pad to dual subpixels of a second color.

In another aspect, embodiments of the present disclosure can provide a data driving circuit for transferring image data to a display panel in which pixels including a white subpixel and colored subpixel are arranged in a matrix form including, a plurality of first latch circuits for receiving image data transmitted from a timing controller, a plurality of second latch circuits for receiving image data from the first latch circuit at a specified timing, a digital-to-analog converter converting the image data of the plurality of second latch circuits into analog image data, and a plurality of output buffer for adjusting a output level of the analog image data to supply to the display panel, wherein the second latch circuit corresponding to the white subpixel is connected in a 1:1 manner to the first latch circuit, two second latch circuits corresponding to two adjacent colored subpixels corresponding to the same color in a first direction are connected to one first latch circuit, luminance data voltage is applied to the white subpixel, and a same data voltage is applied to two adjacent colored subpixels corresponding to the same color.

In another aspect, embodiments of the present disclosure can provide a display panel including a plurality of pixels including a white subpixel and a colored subpixel and arranged in a matrix form, and a data pad connecting two adjacent colored subpixels with the same color in a first direction, wherein luminance data voltage is applied to the white subpixel, and a same data voltage is applied to two adjacent colored subpixels with the same color in the first direction.

According to embodiments of the present disclosure, it is possible to provide a display device, a data driving circuit, and a display panel capable of efficiently displaying YCbCr image data as WRGB image data.

In addition, according to embodiments of the present disclosure, it is possible to provide a display device, a data driving circuit, and a display panel capable of displaying YCbCr image data as WRGB image data while simplifying the structure of a driving circuit.

In addition, according to embodiments of the present disclosure, it is possible to provide a display device, a data driving circuit, and a display panel capable of displaying YCbCr image data as WRGB image data by changing the structure of the display panel.

In addition, according to embodiments of the present disclosure, it is possible to provide a display device, a data driving circuit, and a display panel capable of changing a driving method according to a format of received image data.

DETAILED DESCRIPTION OF THE EMBODIMENTS

Figure 1:
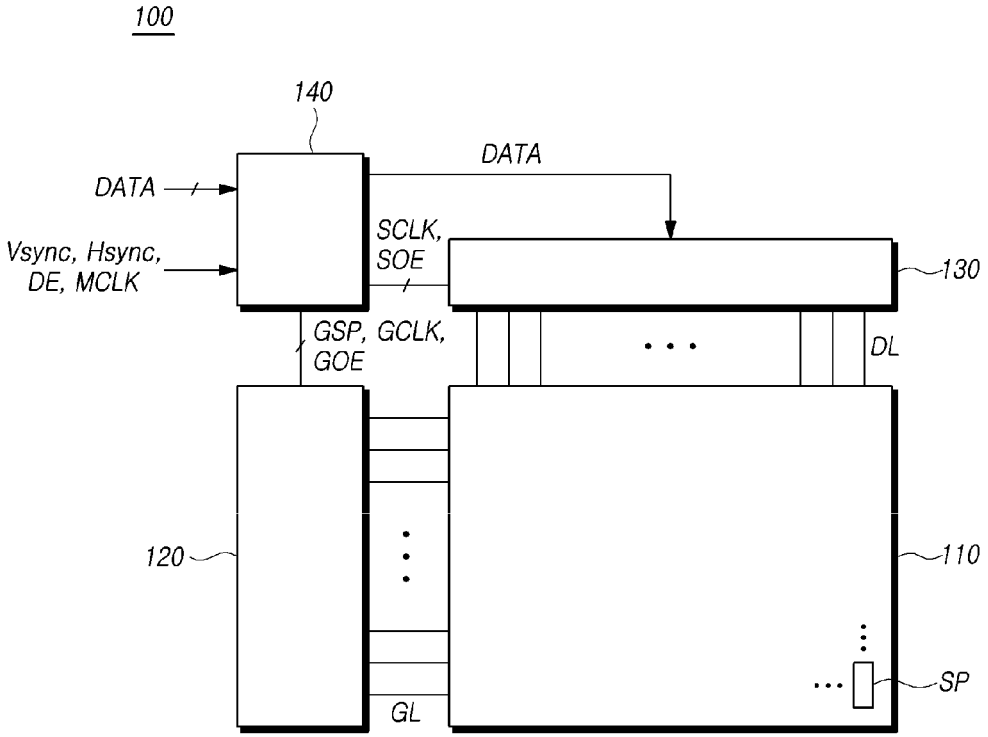
FIG. 1 is a diagram illustrating a schematic configuration of a display device according to embodiments of the present disclosure.

In the following description of examples or embodiments of the present invention, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present invention, detailed descriptions of well-known functions and components incorporated herein will be omitted when it is determined that the description can make the subject matter in some embodiments of the present invention rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" can be used herein to describe elements of the present invention. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element can be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms can be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that can be caused by various factors (e.g., process factors, internal or external impact, noise, etc.) even when a relevant description is not specified. Further, the term "may" fully encompasses all the meanings of the term "can".

All the components of each display device according to all embodiments of the present disclosure are operatively coupled and configured.

FIG. 1 is a diagram illustrating a schematic configuration of a display device according to embodiments of the present disclosure.

Referring to FIG. 1, a display device 100 according to embodiments of the present disclosure can include a display panel 110, a gate driving circuit 120, a data driving circuit 130, and a timing controller 140.

The display panel 110 can display the image based on a scan signal transmitted from the gate driving circuit 120 through a plurality of gate lines GL and a data voltage transmitted from the data driving circuit 130 through a plurality of data lines DL.

In the case of a liquid crystal display (LCD), the display panel 110 includes a liquid crystal layer formed between two substrates, and can be operated in any known mode such as twisted nematic (TN) mode, vertical alignment (VA) mode, in-plane switching (IPS) mode, fringe field switching (FFS) mode. On the other hand, in the case of an organic light-emitting display (OLED), the display panel 110 can be implemented in atop emission method, a bottom emission method, or a dual emission method.

In the display panel 110, a plurality of pixels can be arranged in a matrix form, and each pixel can be composed of a subpixel SP having a different color, for example, a white subpixel, a red subpixel, a green subpixel, and a blue subpixels, and each subpixel SP can be defined by a plurality of data lines DL and a plurality of gate lines GL. One sub-pixel SP can include a thin film transistor (TFT) formed in a region where one data line DL and one gate line GL intersect, a light-emitting device such as organic light emitting diode (OLED) for charging the data voltage, and a storage capacitor for maintaining a voltage by being electrically connected to the light-emitting device.

For example, in the case of the WRGB display device 100 having a resolution of 2,160×3,840, the 2,160 gate lines GL and all 3,840×4=15,360 data lines DL can be provided due to each of 3,840 data lines is connected to the four sub-pixels WRGB, and subpixels SP can be disposed at points where these gate lines GL and data lines DL intersect with each other.

The timing controller 140 can control the gate driving circuit 120 and the data driving circuit 130. The timing controller 140 can receive a timing signal such as a vertical synchronization signal Vsync, a horizontal synchronization signal Hsync, a data enable signal DE, and a main clock MCLK, and digital image data DATA from a host system.

The timing controller 140 controls the gate driving circuit 120 based on scan timing control signals such as a gate start pulse GSP, a gate clock signal GCLK, and a gate output enable signal GOE. In addition, the timing controller 140 controls the data driving circuit 130 based on data timing control signals such as a source sampling clock signal SCLK and a source output enable signal SOE.

The gate driving circuit 120 sequentially drives the plurality of gate lines GL by sequentially supplying scan signals to the display panel 110 through the plurality of gate lines GL. Here, the gate driving circuit 120 can be also referred to as a scan driving circuit or a gate driving integrated circuit GDIC.

The gate driving circuit 120 can include one or more gate driving integrated circuits GDIC, and can be located on only one side or both sides of the display panel 110 according to a driving method. Alternatively, the gate driving circuit 120 can be embedded in a bezel area of the display panel 110 and implemented in a GIP (Gate-in-panel) form.

The gate driving circuit 120 sequentially supplies scan signals of an on voltage or an off voltage to a plurality of gate lines GL according to the control of the timing controller 140. To this end, the gate driving circuit 120 can include a shift register or a level shifter.

The data driving circuit 130 receives digital image data DATA from the timing controller 140, converts the digital image data DATA into an analog data voltage, and supplies to a plurality of data lines DL to drive the plurality of the data lines DL. Here, the data driving circuit 130 can be also referred to as a source driving circuit or a source driving integrated circuit SDIC.

The data driving circuit 130 can include one or more source driving integrated circuits SDIC, and the source driving integrated circuit SDIC can be connected to a bonding pad of the display panel 110 in a TAB (Tape Automated Bonding) method or a COG (Chip-on-glass) method, or can be directly disposed on the display panel 110. In some cases, each source driving integrated circuit SDIC can be integrated and disposed on the display panel 110. In addition, each source driving integrated circuit SDIC can be implemented in a COF (Chip-on-film) method. In this case, each source driving integrated circuit SDIC can be mounted on a circuit film, and can be electrically connected to the data line DL of the display panel 110.

When the specific gate line GL is turned on by the gate driving circuit 120, the data driving circuit 130 converts the digital image data DATA received from the timing controller 140 into an analog data voltage and supplies to the plurality of data lines DL.

The data driving circuit 130 can be located only above or below the display panel 110, or can be located both above and below the display panel 110 according to a driving method or a design method.

The data driving circuit 130 can include a shift register, a latch circuit, a digital-to-analog converter, an output buffer, and the like. Here, the digital-to-analog converter is a component for converting the digital image data DATA received from the timing controller 140 into an analog data voltage in order to supply to the data line DL.

Meanwhile, the display device 100 can further include a memory. The memory can temporarily store digital image data DATA output from the timing controller 140 and can output the digital image data DATA to the data driving circuit 130 at a specified timing.

The memory can be disposed inside or outside the data driving circuit 130, and when disposed outside the data driving circuit 130, the memory can be disposed between the timing controller 140 and the data driving circuit 130. In addition, the memory can further include a buffer memory for storing digital image data DATA received from the outside and supplying the stored digital image data DATA to the timing controller 140.

In addition, the display device 100 can include an interface for inputting/outputting signals or communicating with other external electronic devices or electronic components. The interface can include, for example, one or more of a low-voltage differential signaling (LVDS) interface, a mobile industry processor interface (MIPI), and a serial interface.

The display device 100 can be various types of devices such as a liquid crystal display, an organic light emitting display, and a plasma display panel.

Figure 2:
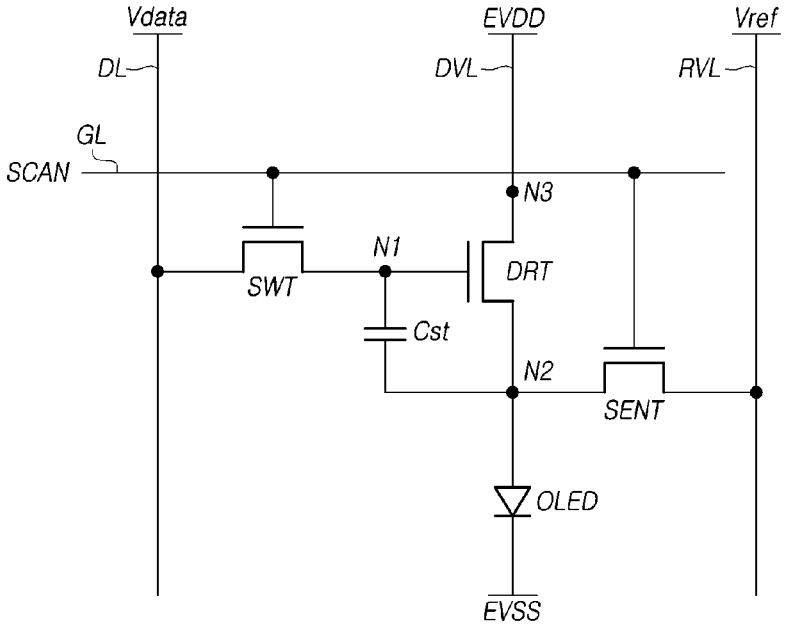
FIG. 2 is a circuit diagram of a subpixel arranged in a display device according to embodiments of the present disclosure.

FIG. 2 is a circuit diagram of a subpixel arranged in a display device according to embodiments of the present disclosure.

Referring to FIG. 2, each subpixel SP arranged in the display device 100 according to embodiments of the present disclosure can include one or more transistors and a capacitor, and an organic light emitting diode OLED can be disposed as a light emitting device.

For example, the subpixel SP can include a driving transistor DRT, a switching transistor SWT, a sensing transistor SENT, a storage capacitor Cst, and an organic light emitting diode OLED.

The driving transistor DRT has a first node N1, a second node N2, and a third node N3. The first node N1 of the driving transistor DRT can be a gate node to which the data voltage Vdata is applied through the data line DL when the switching transistor SWT is turned on. The second node N2 of the driving transistor DRT can be electrically connected to an anode electrode of the organic light emitting diode OLED, and can be a source node or a drain node. The third node N3 of the driving transistor DRT is electrically connected to the driving voltage line DVL to which the driving voltage EVDD is applied, and can be a drain node or a source node.

Here, during the display driving period, the driving voltage EVDD required for driving the display can be supplied to the driving voltage line DVL. For example, the driving voltage EVDD required for driving the display can be 27V.

The switching transistor SWT is electrically connected between the first node N1 of the driving transistor DRT and the data line DL, and operates according to a scan signal SCAN supplied by the gate line GL connected to the gate node. In addition, when the switching transistor SWT is turned on, the operation of the driving transistor DRT is controlled by transferring the data voltage Vdata supplied through the data line DL to the gate node of the driving transistor DRT.

The sensing transistor SENT is electrically connected between the second node N2 of the driving transistor DRT and a reference voltage line RVL, and operates according to a scan signal SCAN supplied by the gate line GL connected to the gate node. When the sensing transistor SENT is turned on, a sensing reference voltage Vref supplied through the reference voltage line RVL is transmitted to the second node N2 of the driving transistor DRT.

For example, by controlling the switching transistor SWT and the sensing transistor SENT, the voltage of the first node N1 and the voltage of the second node N2 of the driving transistor DRT are controlled, so that the driving current for driving the organic light emitting diode OLED can be supplied.

The switching transistor SWT and the sensing transistor SENT can be connected to the same single gate line GL or to different signal lines. Here, it is illustrated an exemplary structure in which the switching transistor SWT and the sensing transistor SENT are connected to the same gate line GL. In this case, the switching transistor SWT and the sensing transistor SENT can be simultaneously controlled by the scan signal SCAN transmitted through one gate line GL and the aperture ratio of the subpixel SP can be improved.

Meanwhile, the transistor disposed in the subpixel SP can be formed of not only an n-type transistor but also a p-type transistor. Here, a case of an n-type transistor is illustrated as an example.

The storage capacitor Cst is electrically connected between the first node N1 and the second node N2 of the driving transistor DRT, and maintains the data voltage Vdata for one frame.

The storage capacitor Cst can be connected between the first node N1 and the third node N3 of the driving transistor DRT according to the type of the driving transistor DRT. The anode electrode of the organic light emitting diode OLED can be electrically connected to the second node N2 of the driving transistor DRT, and a base voltage EVSS can be applied to the cathode electrode of the organic light emitting diode OLED. Here, the base voltage EVSS can be a ground voltage or a voltage higher or lower than the ground voltage. Further, the base voltage EVSS can vary according to the driving state. For example, the base voltage EVSS at the time of driving the image and the base voltage EVSS at the time of driving the sensing can be set differently from each other.

Figure 3:
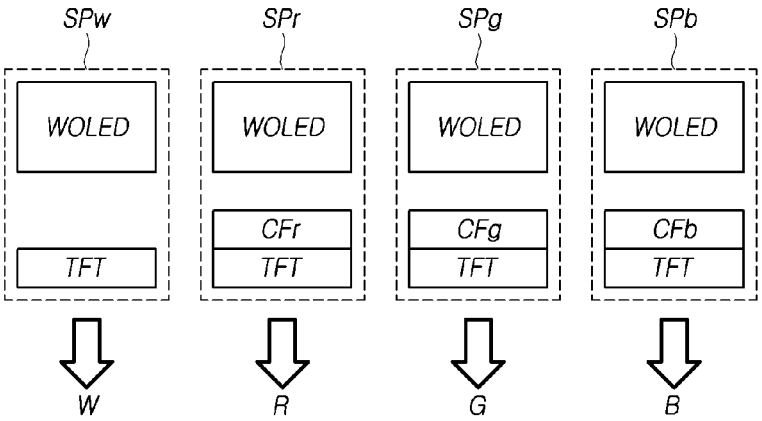
FIG. 3 is a hierarchical diagram illustrating a schematic cross-section of a subpixel in a display device according to embodiments of the present disclosure.

FIG. 3 is a hierarchical diagram illustrating a schematic cross-section of a subpixel in a display device according to embodiments of the present disclosure.

Referring to FIG. 3, in a display device 100 according to embodiments of the present disclosure, a display panel 110 can have a subpixel structure (commonly referred to a WRGB subpixel) including a white subpixel SPw, a red subpixel SPr, a green subpixel SPg, and a blue subpixel SPb in order to increase the light efficiency and prevent the decrease in the luminance and color sense of pure colors. For example, one pixel can consist of four subpixels SPw, SPr, SPg, SPb including the white subpixel SPw, the red subpixel SPr, the green subpixel SPg, and the blue subpixel SPb.

In this case, a RGB subpixel can be referred to as a colored subpixel, separated from the white subpixel SPw. In addition, the color of the subpixel SP constituting the pixel is not limited to white, red, green, and blue, and the color can be variously changed according to the type of the display device 100.

One subpixel SP can include a switching transistor SWT, a driving transistor DRT, a storage capacitor Cst, a compensation circuit, and an organic light emitting diode OLED. The organic light emitting diode OLED operates to emit light according to a driving current formed by the driving transistor DRT.

The switching transistor SWT operates to switch in response to the scan signal SCAN supplied through the gate line GL so that the data voltage Vdata supplied through the data line DL is stored in the storage capacitor Cst. The driving transistor DRT operates according to the data voltage stored in the storage capacitor Cst so that a driving current flows between the driving voltage EVDD and the base voltage EVSS.

The compensation circuit compensates for a characteristic value such as mobility or a threshold voltage of the driving transistor DRT. The compensation circuit can consist of one or more transistors and capacitors.

The subpixel SP having such a configuration can be classified into a top-emission method, a bottom-emission method, or a dual-emission method according to a structure.

Meanwhile, the WRGB subpixels SPw, SPr, SPg, SPb can be implemented in a manner using white organic light emitting diode WOLED and RGB color filter CFr, CFg, CFb, or a manner of dividing and forming light-emitting materials included in organic light-emitting diode OLED into WRGB colors.

In the case of using a white organic light emitting diode WOLED and RGB color filters CFr, CFg, CFb, the RGB subpixel SPr, SPg, SPb is consisted of a transistor TFT, the RGB color filters CFr, CFg, CFb and a white organic light emitting diode WOLED, while the white subpixel SPw can be consisted of a transistor TFT and a white organic light-emitting diode WOLED.

For example, the RGB subpixel SPr, SPg, SPb includes the RGB color filter CFr, CFg, CFb in order to convert the white color light transmitted from the white organic light emitting diode WOLED into red, green, and blue color light. On the other hand, the white subpixel SPw does not include a color filter since it directly emits white color light transmitted from the white organic light emitting diode WOLED.

In the method of using WRGB subpixels SPw, SPr, SPg, SPb, since a white colored light emitting material is deposited on all subpixels SP unlike the method in which red, green, and blue colored light emitting materials are independently deposited on each subpixel SP, it is possible to manufacture a large display panel without using a fine metal mask, and there is an effect of reducing power consumption while extending the lifespan.

Here, it has been described an exemplary structure of the subpixel, for example, in the organic light emitting display, however, the present disclosure is not limited to the organic light emitting display, and can be applied to all display devices including the white subpixel SPw and the colored subpixel.

Figure 4:
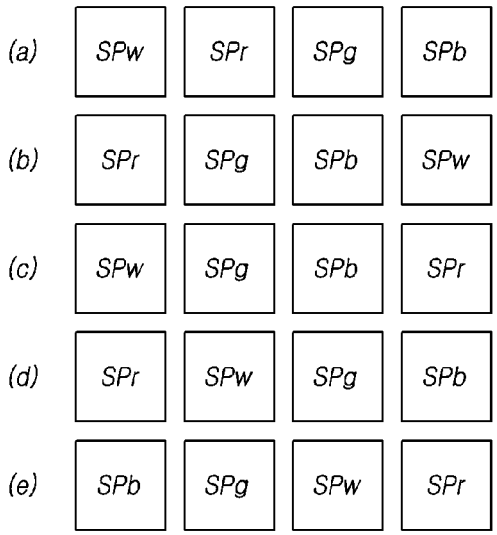
FIG. 4 is a diagram illustrating an example of an arrangement order of subpixels in a display device according to embodiments of the present disclosure.

FIG. 4 is a diagram illustrating an example of an arrangement order of subpixels in a display device according to embodiments of the present disclosure.

Referring to FIG. 4, in the display device 100 according to embodiments of the present disclosure, the display panel 110 can variously arrange the subpixels SP in order to improve color purity or expressiveness, as well as to meet a target color coordinate. For example, the display panel 110 can be configured to be arranged in the order of WRGB subpixels SPw, SPr, SPg, SPb as shown (a) in FIG. 4, or can be configured to be arranged in the order of RGBW subpixels SPr, SPg, SPb, SPw as shown (b) in FIG. 4. Alternatively, an arrangement structure of the display panel 110 can be formed in the order of WGBR subpixels SPw, SPg, SPb, SPr as shown (c) in FIG. 4, or in the order of RWGB subpixels SPr, SPw, SPg, SPb as shown (d) in FIG. 4 or in the order of BGWR subpixels SPb, SPg, SPw, SPr as shown (e) in FIG. 4. In addition to this arrangement, the display panel 110 can have a subpixel SP structure arranged in various orders.

The display device 100 having such a structure can emit light in part or all of the RGB subpixels SPr, SPg, SPb together with the white subpixel SPw in order to express a desired color coordinate on the display panel 110 by using WRGB subpixels SPw, SPr, SPg, SPb.

In this case, the image data input to the display device 100 can be RGB image data or YCbCr image data of various formats, and the timing controller 140 of the display device 100 can convert the input image data into WRGB image data of a 4:4:4 format being matched 1:1 with WRGB subpixels SPw, SPr, SPg, SPb and transmit to the corresponding subpixel SP.

Figure 5:
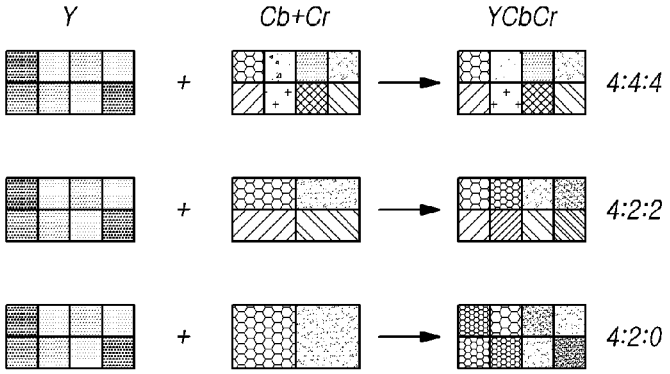
FIG. 5 is a diagram illustrating an example of image data that can be input to a display device according to embodiments of the present disclosure.

FIG. 5 is a diagram illustrating an example of image data that can be input to a display device according to embodiments of the present disclosure.

Referring to FIG. 5, the color image data capable of being input to a display device 100 according to embodiments of the present disclosure can be RGB image data, or YCbCr image data in a 4:4:4 format, a 4:2:2 format, or a 4:2:0 format.

Based on two adjacent 2×2 pixels, the 4:4:4 format represents a format in which the number of samples of luminance data (Y) and color difference data (Cb and Cr) in each row is 4. On the other hand, in the 4:2:2 format, the number of samples of luminance data (Y) in each row is 4, but the number of samples of color difference data (Cb and Cr) is 2. In addition, in the 4:2:0 format, the number of samples of luminance data (Y) in each row is 4 and the number of samples of the color difference (Cb and Cr) is 2, but the number of times the sampling of the color difference data (Cb and Cr) is changed between the first row and the second row becomes 0, so that the color difference data (Cb and Cr) of the first row and the second row are the same.

For example, in the 4:4:4 format, the color difference data (Cb and Cr) are sampled at the same ratio as the luminance data (Y), and in the 4:2:2 format, the color difference data (Cb and Cr) are sampled at a ratio of 1/2 compared to the luminance data (Y), and in the 4:2:0 format, the color difference data (Cb and Cr) are sampled at a ratio of 1/4 of the luminance data (Y).

In this case, YCbCr image data used for TV broadcasts, sports broadcasts, movies, etc. can be in the 4:2:0 format, and YCbCr image data used in games can be in various formats of the 4:4:4 format, 4:2:2 format or 4:2:0 format, and YCbCr image data used in a computer can be in the 4:4:4 format. Accordingly, in the display device 100 having a WRGB subpixel structure, it is required a process of effectively converting and displaying YCbCr image data into WRGB image data.

The present disclosure discloses a display device, a data driving circuit, and a display panel capable of converting and displaying YCbCr image data of the 4:2:2 or 4:2:0 format to be suitable for a WRGB subpixel structure.

Figure 6:
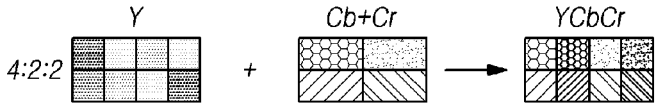
FIG. 6 is a diagram conceptually illustrating a process of converting YCbCr image data of 4:2:2 format into image data for display in a display device according to embodiments of the present disclosure.

FIG. 6 is a diagram conceptually illustrating a process of converting YCbCr image data of 4:2:2 format into image data for display in a display device according to embodiments of the present disclosure.

Referring to FIG. 6, in the case that YCbCr image data (Image Source) in 4:2:2 format is input to the display device 100 according to the embodiments, YCbCr image data includes 4 luminance data (Y) and two color difference data (Cb and Cr) based on 2×2 pixels.

For example, in the YCbCr image data of 4:2:2 format, the luminance data (Y) has one value specified for each pixel, whereas the color difference data (Cb and Cr) have the same value for two adjacent pixels in the row direction.

When the YCbCr image data is received, the display device 100 according to the embodiments converts it into RGB image data corresponding to each pixel. In this case, the YCbCr image data can be converted into RGB image data by the host system inside the display device 100 or into RGB image data by the timing controller 140.

The RGB image data corresponding to each pixel can be expressed in a row and column in which the pixel is located. For example, $R_{11}G_{11}B_{11}$ can correspond to RGB image data corresponding to the pixel in 1 row and 1 column, and $R_{12}G_{12}B_{12}$ can correspond to RGB image data corresponding to the pixel in 1 row and 2 columns.

In this case, in the YCbCr image data of 4:2:2 format, the color difference data (Cb and Cr) have the same value for two adjacent pixels, for example, The color difference data $Cb_{11}Cr_{11}$ for the pixel in 1 row and 1 column can have the same value as the color difference data $Cb_{12}Cr_{12}$ for the pixel in 1 row and 2 columns. Therefore, in the case of RGB image data corresponding to YCbCr image data, the RGB image data $R_{11}G_{11}B_{11}$ corresponding to the pixel in 1 row and 1 column and the RGB image data $R_{12}G_{12}B_{12}$ corresponding to the pixel in 1 row and 2 columns can be expressed by using one color difference data.

In the display device 100 of the present disclosure, one luminance data Y included in the YCbCr image data of 4:2:2 format is matched to one white subpixel SPw, but the color component data included in one color difference data CbCr is matched to two adjacent RGB subpixels SPr, SPg, SPb, so that the YCbCr image data can be displayed as WRGB image data.

To this end, in the display device 100 of the present disclosure, the same data voltage corresponding to one color component data can be applied to each of two adjacent RGB subpixels SPr, SPg, SPb through the signal line structure of the data driving circuit 130, or the same data voltage corresponding to one color component data can be applied to each of two adjacent RGB subpixels SPr, SPg, SPb through the structure of the data line DL formed in the subpixel SP of the display panel 110.

Figure 7:
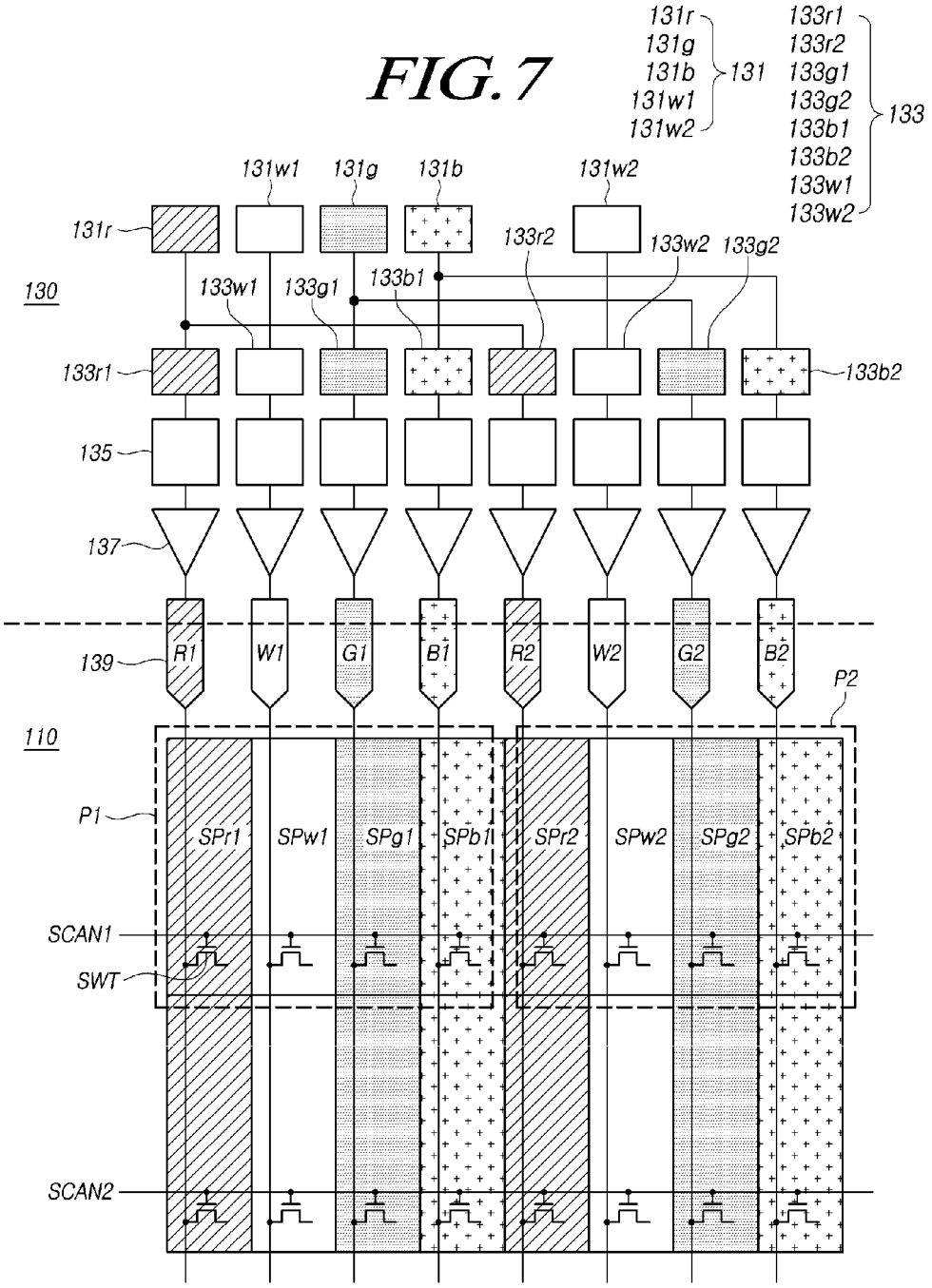
FIG. 7 is a diagram illustrating a structure of a data driving circuit for applying the same data voltage to each of two adjacent RGB subpixels in a display device according to embodiments of the present disclosure.

FIG. 7 is a diagram illustrating a structure of a data driving circuit for applying the same data voltage to each of two adjacent RGB subpixels in a display device according to embodiments of the present disclosure.

Referring to FIG. 7, in the display device 100 according to embodiments of the present disclosure, a data driving circuit 130 can include a first latch circuit 131, a second latch circuit 133, a digital-to-analog converter 135, and an output buffer 137.

Here, the first latch circuit 131 can be a concept including all of the plurality of first latch circuits 131*w*1, 131*w*2, 131*r*, 131*g*, 131*b*, and the first white latch circuit 131*w* can include a plurality of first white latch circuits 131*w*1, 131*w*2.

Further, the second latch circuit 133 is a concept including all of a plurality of second latch circuits 133*r*1, 133*r*2, 133*w*1, 133*w*2, 133*g*1, 133*g*2, 133*b*1, 133*b*2, and a second red latch circuit 133*r* can include a plurality of second red latch circuits 133*r*1 and 133*r*2. It could be expressed in the same way for other colored latch circuits.

The data driving circuit 130 can include a data controller that controls the first and second latch circuits 131, 133 according to the data control signal transmitted from the timing controller 140. In addition, the data controller can control the output level of the data voltage Vdata supplied to the display panel 110 by adjusting the bias voltage applied to the output buffer 137.

The data driving circuit 130 can supply the digital image data DATA received from the timing controller 140 to the display panel 110 through the first latch circuit 131, the second latch circuit 133, the digital-to-analog converter 135, and the output buffer 137.

The first latch circuit 131 temporarily stores the digital image data DATA transmitted from the lookup table, and accordingly, the digital image data DATA can be sequentially stored in the first latch circuit 131 according to a position to be output to the display panel 110. The first latch circuit 131 can transmit the latched digital image data DATA at a specified timing to the second latch circuit 133 under the control of the data controller.

In this case, the second latch circuits 133*w*1, 133*w*2 corresponding to the white subpixels SPw1, SPw2 are connected in a 1:1 manner to the first latch circuits 131*w*1, 131*w*2, respectively. However, for the second latch circuits 133*r*1, 133*r*2, 133*g*1, 133*g*2, 133*b*1, 133*b*2 corresponding to the red subpixels SPr1, SPr2, the green subpixels SPg1, SPg2, and the blue subpixels SPb1, SPb2, two corresponding second latch circuits (133*r*1 and 133*r*2, 133*g*1 and 133*g*2, 133*b*1 and 133*b*2) are connected to one first latch circuit 131*r*, 131*g*, 131*b* for each of two RGB subpixels that have the same color and are adjacent in the row direction, so that the same RGB data voltage corresponding to one color component data can be applied for each of two adjacent RGB subpixels (SPr1 and SPr2, SPg1 and SPg2, SPb1 and SPb2).

For example, as shown, in the case of a 2×2 pixel (2×8 subpixel), a second red latch circuit 133*r*1 corresponding to the first red subpixel SPr1 of the first pixel P1 and the second red latch circuit 133*r*2 corresponding to the second red subpixel SPr2 of the second pixel P2 adjacent thereto are together connected to one first red latch circuit 131*r*, so that the same data voltage corresponding to one color component data can be applied to the red subpixels SPr1, SPr2.

Similarly, for the first pixel P1 and the second pixel P2 located adjacent to each other, the second green latch circuit 133*g*1 corresponding to the first green subpixel SPg1 having the same green color and the second green latch circuit 133*g*2 corresponding to the second green subpixel SPg2 can be connected to one first green latch circuit 131*g* together. In addition, two second blue latch circuits 133*b*1, 133*b*2 respectively corresponding to the first blue subpixel SPb1 and the second blue subpixel SPb2 located adjacent to each other and having the same blue color can be connected to one first blue latch circuit 131*b* together.

On the other hand, since each white subpixel SPw corresponds to the luminance data Y, one second white latch circuit 133*w*1 corresponding to the first white subpixel SPw1 and one second white latch circuit 133*w*2 corresponding to the second white subpixel SPw2 are connected to different first white latch circuits 131*w*1, 131*w*2, respectively.

In this case, since the YCbCr image data of the 4:2:2 format has different values for the subpixels in the column direction, it is required to arrange one switching transistor SWT for light-emitting the subpixel SP for each gate line to which the scan signals SCAN1, SCAN2, . . . are applied so as to individually drive the subpixels SP of each column.

The second latch circuit 133 having such a structure can transfer the digital image data DATA transmitted from the first latch circuit 131 to the digital-to-analog converter 135 under the control of the data controller.

The digital-to-analog converter 135 can convert the digital image data DATA transmitted to the digital-to-analog converter 135 into a grayscale voltage using a gamma reference voltage.

The output buffer 137 can include a plurality of driving amplifiers, and can output the grayscale voltage received from the digital-to-analog converter 135 to the display panel 110. The grayscale voltage can be made of the analog data voltage Vdata corresponding to the digital image data DATA.

In this case, the data driving circuit 130 can be bonded to the display panel 110 in a TAB (Tape Automated Bonding) method or a COG (Chip-on-glass) method through the data pad 139, or can be disposed directly on the display panel 110.

As described above, since the YCbCr image data of the 4:2:2 format has the same data voltage indicated by the adjacent RGB subpixels SPr, SPg, SPb, the first latch circuit 131 inside the data driving circuit 130 is connected to two adjacent second latch circuits 133 corresponding to the same color.

In this state, the timing controller 140 can transmit RGB subpixel data corresponding to two adjacent pixels to the data driving circuit 130 only once, and the data driving circuit 130 transmits the digital image data DATA of the first latch circuit 131 to the second latch circuit 133, thereby reducing the amount of transmitted data and simplifying the configuration of the data driving circuit 130, and also effectively displaying the YCbCr image data as WRGB image data.

As described above, a structure in which the first latch circuit 131 in the data driving circuit 130 is connected to two adjacent second latch circuits 133 corresponding to the same color can be referred to as a simplified driving circuit structure.

Figure 8:
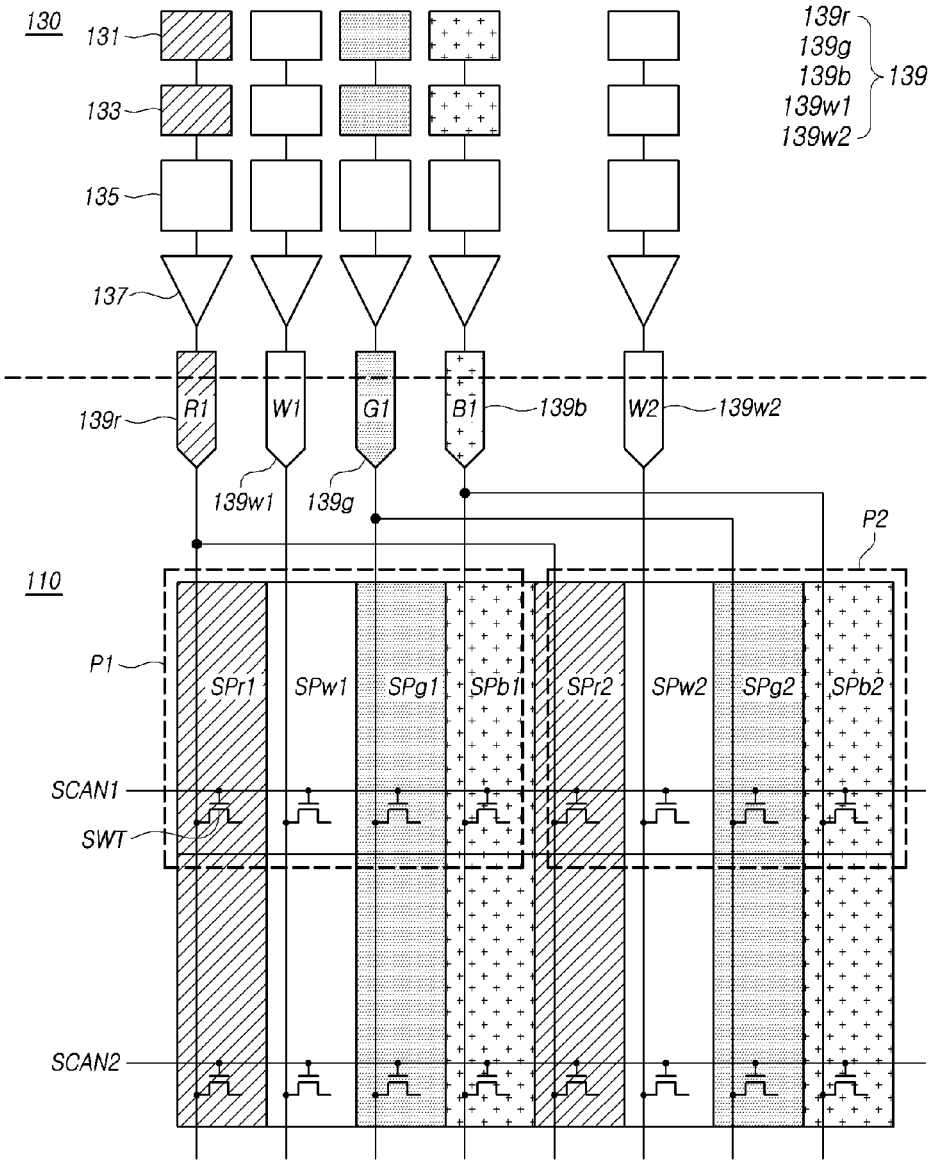
FIG. 8 is a diagram illustrating a structure for applying the same data voltage to two adjacent RGB subpixels in a display device according to another embodiment of the present disclosure.

FIG. 8 is a diagram illustrating a structure for applying the same data voltage to two adjacent RGB subpixels in a display device according to another embodiment of the present disclosure.

Referring to FIG. 8, the display device 100 according to another embodiment of the present disclosure can display YCbCr image data as WRGB image data by connecting two adjacent RGB subpixels SPr, SPg, SPb representing the same color with one data line DL.

In other words, in YCbCr image data of 4:2:2 format, the YCbCr image data can be displayed by connecting two adjacent RGB subpixels SPr, SPg, SPb with one data line DL so as to apply the same data voltage corresponding to one color component data for adjacent RGB subpixels SPr, SPg, SPb.

For example, in the case of a 2×2 pixel (2×8 subpixel), for the first pixel P1 and the second pixel P2 in adjacent positions, two data lines corresponding to the first red subpixel SPr1 and the second red subpixel SPr2 having the same red color are connected to one red data pad 139*r*, so that the same data voltage corresponding to one color component data can be applied to two adjacent red subpixels SPr1, SPr2.

Similarly, two data lines corresponding to the first green subpixel SPg1 and the second green subpixel SPg2 located adjacent to each other and having the same green color can be connected together to one green data pad 139*g*, and two data lines corresponding to the first blue subpixel SPb1 and the second blue subpixel SPb2 located adjacent to each other and having the same blue color can be connected together to one blue data pad 139*b*.

On the other hand, since each white subpixel SPw corresponds to the luminance data Y, the data line corresponding to the first white subpixel SPw1 and the data line corresponding to the second white subpixel SPw2 are individually connected to different white data pads 139*w*1, 139*w*2, respectively.

As described above, the data lines DL corresponding to two adjacent subpixels SP of the same color are connected to one data pad 139, so that the same data voltage corresponding to one color component data can be applied to each of two adjacent RGB subpixels SPr, SPg, SPb.

In this case, the data driving circuit 130 can supply the digital image data DATA received from the timing controller 140 to the display panel 110 through a first latch circuit 131, a second latch circuit 133, a digital-to-analog converter 135, and a the output buffer 137.

However, in the above structure, since the data lines DL corresponding to two adjacent subpixels SP of the same color are connected to one data pad 139, in the data driving circuit 130, there is no need to connect the corresponding two second latch circuits 133 to one first latch circuit 131 for each of the two RGB subpixels adjacent to each other in the row direction and having the same color.

As a result, there is no need to apply a data voltage to each of the eight subpixels SP arranged in the row direction, and the data voltage can be applied through two white data pads 139*w*1, 139*w*2 connected to two white subpixels SPw1, SPw2 and three RGB data pads 139*r*, 139*g*, 139*b* connected to three pairs of RGB subpixels SPr, SPg, SPb with the same color.

Therefore, in the case that data lines DL corresponding to two adjacent subpixels SP of the same color are connected to one data pad 139, since five data lines DL are required for 8 subpixels SP in the row direction, it is possible to simplify the configurations of the latch circuits 131, 133, the digital-to-analog converter 135, and the output buffer 137 constituting the data driving circuit 130, and to reduce the number of the data driving circuit 130 constituting the display panel 110.

As described above, a structure in which data lines DL corresponding to two adjacent subpixels SP of the same color are connected to one data pad 139 can be referred to as a simplified panel structure.

Meanwhile, the image data transmitted from the outside can be YCbCr image data of a 4:2:2 format, but can be YCbCr image data of a 4:4:4 format or RGB image data. In consideration of this case, the display device 100 of the present disclosure can display YCbCr image data of 4:4:4 format or RGB image data as WRGB image data while maintaining the simplified driving circuit structure or the simplified panel structure.

To this end, when YCbCr image data of 4:4:4 format or RGB image data is input, the display device 100 of the present disclosure can convert a driving frequency of the display panel 110 to a frequency lower than the frequency for displaying YCbCr image data of 4:2:2 format, and can transmit image data of one horizontal period (1H) two or more times in one clock period of the driving frequency within the data driving circuit 130.

Figure 9:
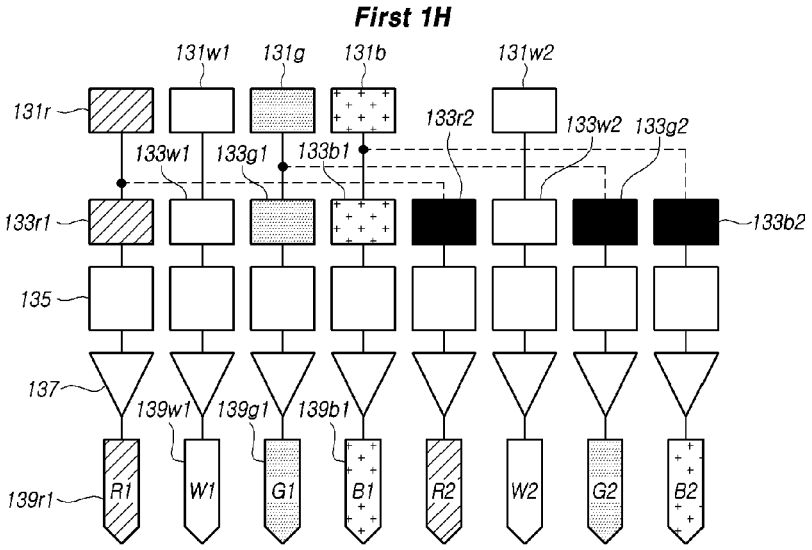
FIG. 9 is a diagram conceptually illustrating a process of processing image data of 4:4:4 format in a display device having a simplified driving circuit structure according to embodiments of the present disclosure.
Figure 9:
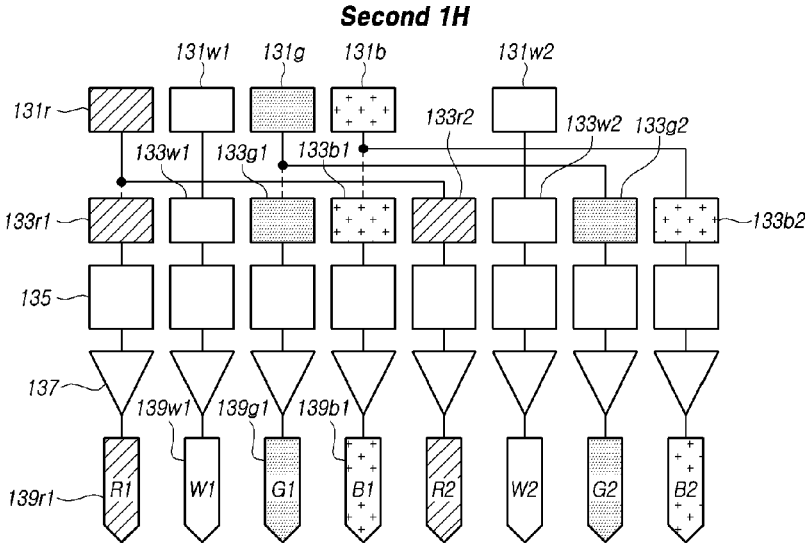

FIG. 9 is a diagram conceptually illustrating a process of processing image data of 4:4:4 format in a display device having a simplified driving circuit structure according to embodiments of the present disclosure.

Referring to FIG. 9, a display device 100 having a simplified driving circuit structure according to embodiments of the present disclosure can implemented as a structure in which a first latch circuit 131 in the data driving circuit 130 is connected to two adjacent second latch circuits 133 corresponding to the same color as in the case shown in FIG. 7.

In the case that the YCbCr image data of 4:4:4 format or RGB image data is input, a host system or a timing controller 140 can convert it into WRGB image data of 4:4:4 format and transfer to the data driving circuit 130.

In this case, for second latch circuits 133*r*1, 133*g*1, 133*b*1 of the RGB color corresponding to the first pixel and the second latch circuit 133*r*2, 133*g*2, 133*b*2 of the RGB color corresponding to the second pixel adjacent thereto, the data driving circuit 130 connects the first latch circuit 131 to two adjacent second latch circuits 133 corresponding to the same color. However, since the second latch circuit 133 transferring the digital image data DATA from the first latch circuit 131 changes over time, it is conceptually illustrated a change in the connection structure over time.

In the simplified driving circuit structure, in order to process image data of 4:4:4 format, the data driving circuit 130 can reduce a driving frequency of the display panel 110, and transmit image data of one horizontal period (1H) several times in one clock period of the driving frequency.

The driving frequency of the display panel 110 can be controlled by changing the frequency of the scan signal SCAN applied to the display panel 110.

For example, in the case that the frequency for processing image data of 4:2:2 format in a simplified driving circuit structure or a simplified panel structure is 120 Hz, when image data of 4:4:4 format is input, the driving frequency of the display panel 110 is reduced to 60 Hz. However, the driving frequency of 60 Hz corresponds to the frequency of operating the display panel 110, and the data driving circuit 130 operates in a structure in which image data of one horizontal period (1H) is transmitted to the second latch circuit 133 twice while maintaining 120 Hz.

For example, during one clock period in which the display panel 110 operates once at a frequency of 60 Hz, the data driving circuit 130 operates at a frequency of 120 Hz, and transfers the digital image data DATA stored in the first latch circuits 131*w*1, 131*r*, 131*g*, 131*b* to the second latch circuits 133*w*1, 133*r*1, 133*g*1, 133*b*1 corresponding to the first pixel in the first 1H period, respectively (see (a) in FIG. 9). In this case, the digital image data DATA stored in the RGB first latch circuits 131*r*, 131*g*, 131*b* is not transferred to the RGB second latch circuits 133*r*2, 133*g*2, 133*b*2 corresponding to the second pixel adjacent to the first pixel.

In the second 1H period, the digital image data DATA stored in the RGB first latch circuits 131*r*, 131*g*, 131*b* is transmitted to the RGB second latch circuits 133*r*2, 133*g*2, 133*b*2 corresponding to the second pixel adjacent to the first pixel (see (b) in FIG. 9).

In this case, the white first latch circuit 131*w*1 and the white second latch circuit 133*w*1 corresponding to the white subpixel SPw are connected in a 1:1 manner.

In this way, when the image data of 4:4:4 format is input, the driving frequency of the display panel 110 is reduced by ½, and the digital image data is sequentially transmitted from the first latch circuit 131 to the adjacent second latch circuit 133 corresponding to the same color during two 1H periods, so that the image can be displayed.

In this case, the driving frequency of the display panel 110 for processing the image data of 4:4:4 format and the number of times the image data of one horizontal period (1H) is transmitted during one clock period of the driving frequency can be variously changed.

Figure 10:
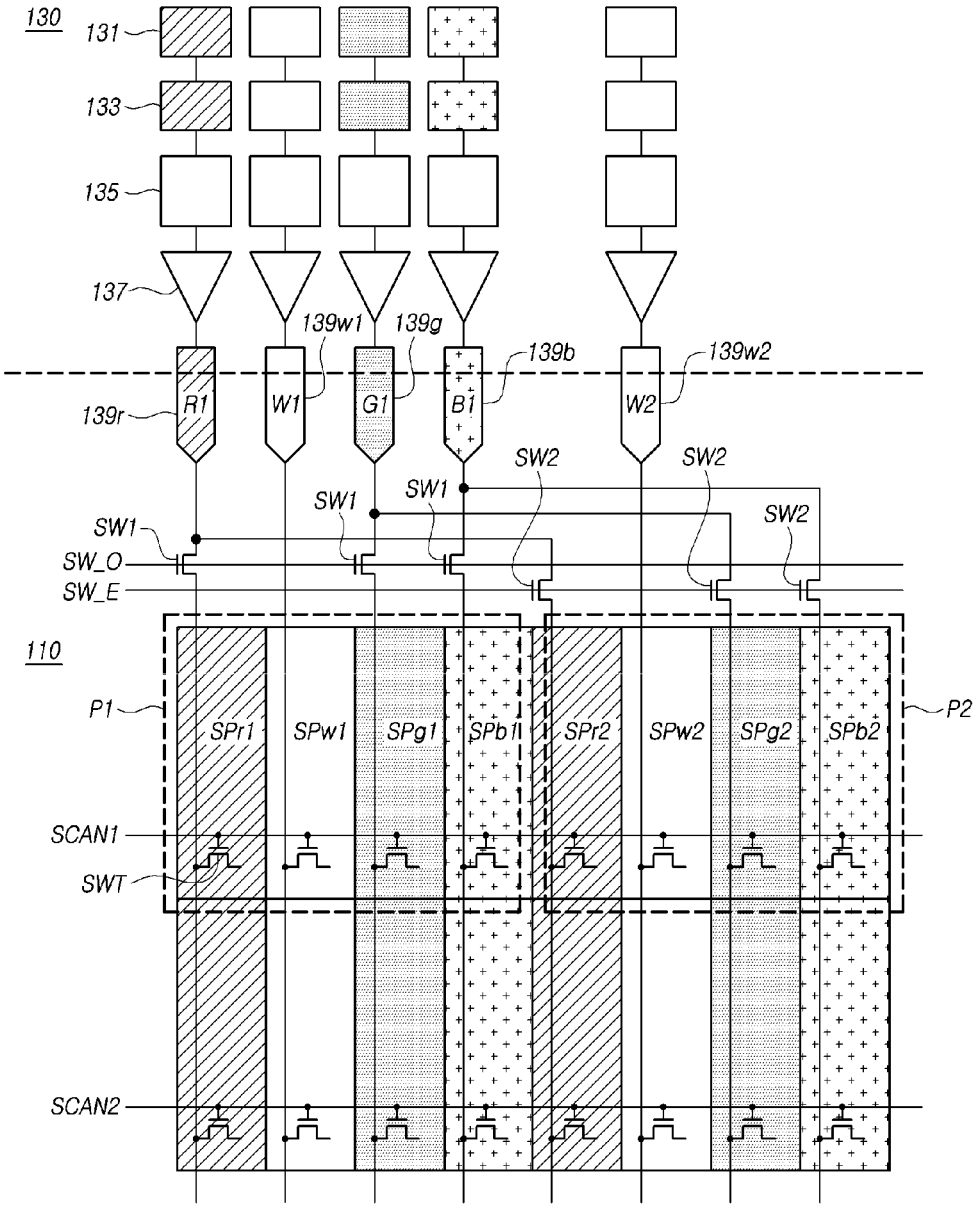
FIG. 10 is a diagram illustrating a structure of a display panel for processing image data of 4:4:4 format in a display device having a simplified panel structure according to embodiments of the present disclosure.

FIG. 10 is a diagram illustrating a structure of a display panel for processing image data of 4:4:4 format in a display device having a simplified panel structure according to embodiments of the present disclosure.

Referring to FIG. 10, a display device 100 having a simplified panel structure according to the embodiments of the present disclosure can implemented as a structure in which two adjacent RGB subpixels SPr, SPg, SPb representing the same color are connected with one data line DL as in the case shown in FIG. 8.

In such a simplified panel structure, in order to process image data of 4:4:4 format, the driving frequency of the display panel 110 can be reduced by ½, and the data driving circuit 130 can sequentially transmit image data of one horizontal period (1H) to adjacent subpixels of the same color twice in one clock period of the driving frequency.

For example, in the case that the frequency for processing image data of 4:2:2 format is 120 Hz, when image data of 4:4:4 format is input, the driving frequency of the display panel 110 is reduced to 60 Hz. However, the driving frequency of 60 Hz corresponds to the frequency of operating the display panel 110, and the data driving circuit 130 operates in a structure in which image data of one horizontal period (1H) is transmitted to the adjacent subpixel twice while maintaining 120 Hz.

To this end, in the display panel 110 of a simplified panel structure, a first switch SW1 for transferring the RGB image data transmitted from the data pad 139 to the first pixel P1 and a second switch SW2 for transferring RGB image data transmitted from the data pad 139 to the adjacent second pixel P2 can be disposed on the data line DL between the data pad 139 and the subpixel SP.

In this state, by sequentially switching a first switching signal SW_O applied to the first switch SW1 connected to the first pixel P1 and a second switching signal SW_E applied to the second switch SW2 connected to the second pixel P2 every 1 horizontal period (1H), image data of one horizontal period (1H) can be alternately transferred to adjacent subpixels of the same color.

For example, when image data of 4:2:2 format is input, the first switch SW1 connected to the first pixel P1 and the second switch SW2 connected to the second pixel P2 can be always turned on, the RGB image data among the image data of 4:2:2 format can be simultaneously supplied to two adjacent subpixels having the same color. On the other hand, when image data of 4:4:4 format is input, the driving frequency of the display panel 110 is reduced by ½, and the first switch SW1 connected to the first pixel P1 and the second switch SW2 connected to the second pixel P2 can be alternately switched, so that the image data of one horizontal period (1H) can be alternately transmitted twice to adjacent subpixels of the same color in one clock period of the display panel 110.

Figure 11:
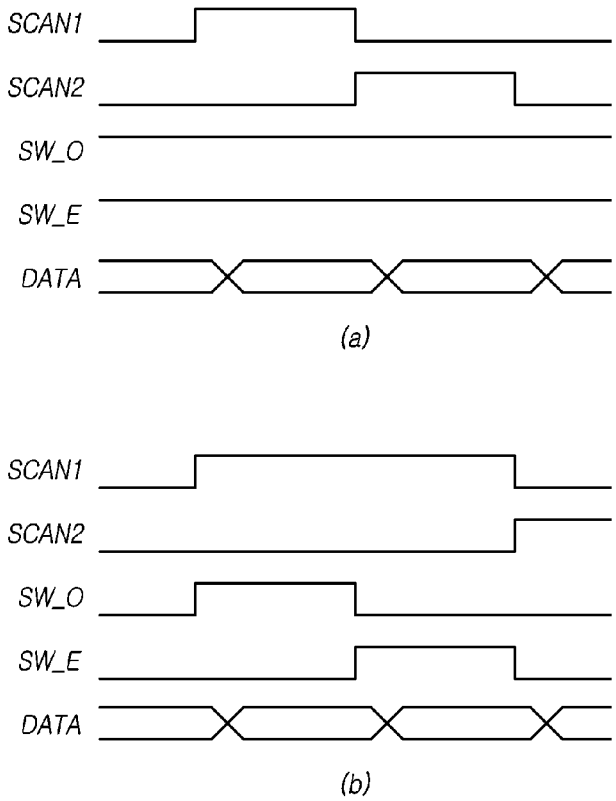
FIG. 11 is a diagram illustrating signal waveforms for processing image data of 4:2:2 format and image data of 4:4:4 format in a display device having a simplified panel structure according to embodiments of the present disclosure.

FIG. 11 is a diagram illustrating signal waveforms for processing image data of 4:2:2 format and image data of 4:4:4 format in a display device having a simplified panel structure according to embodiments of the present disclosure.

Referring to FIG. 11, in the display device 100 having the simplified panel structure of FIG. 10, when image data of 4:2:2 format is input, a first switch SW1 connected to the first pixel P1 and a second switch SW2 connected to the second pixel P2 always maintain a turn-on state (in the case of (a) in FIG. 11).

In this case, the display device 100 having the simplified panel structure of FIG. 10 is substantially the same as the simplified panel structure of FIG. 8, so that the RGB image data among the image data of 4:2:2 format can be simultaneously supplied to two adjacent subpixels having the same color.

On the other hand, when image data of 4:4:4 format is input, the frequencies of the scan signals SCAN1 and SCAN2 applied to the display panel 110 is reduced by ½ to reduce the driving frequency of the display panel 110 by ½, and the first switch SW1 connected to the first pixel P1 and the second switch SW2 connected to the second pixel P2 are alternately switched, so that the image data of one horizontal period (1H) can be alternately transmitted twice to adjacent subpixels of the same color in one clock period of the display panel 110.

Accordingly, the display device 100 of the present disclosure can process the YCbCr image data or RGB image data to a WRGB image data even when image data of 4:2:2 format are input as well as image data of 4:4:4 format.

Figure 12:
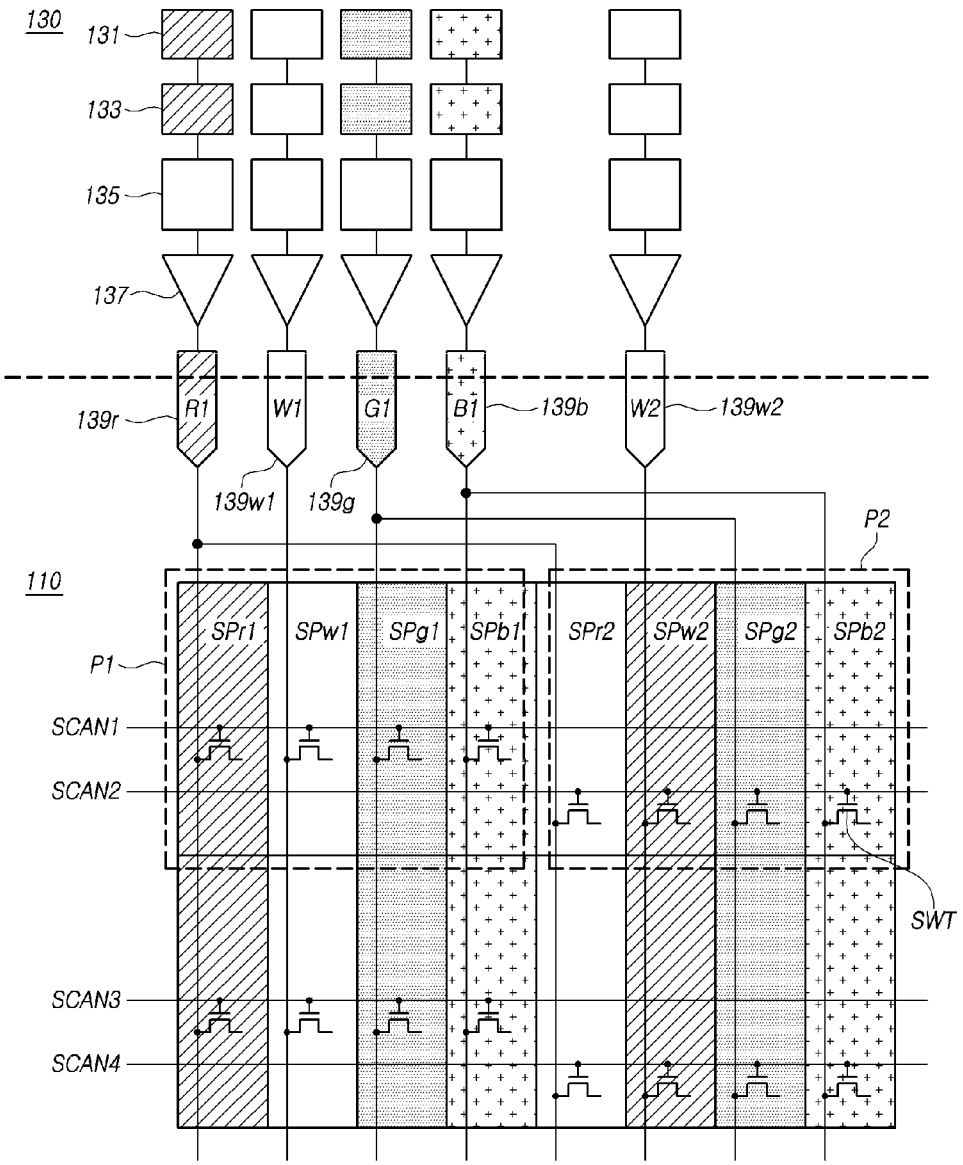
FIG. 12 is a diagram illustrating a structure of a display panel for processing image data of 4:4:4 format in a display device having a simplified panel structure according to another embodiment of the present disclosure.

FIG. 12 is a diagram illustrating a structure of a display panel for processing image data of 4:4:4 format in a display device having a simplified panel structure according to another embodiment of the present disclosure.

Referring to FIG. 12, a display device 100 having a simplified panel structure according to another embodiment of the present disclosure can implemented as a structure in which two adjacent RGB subpixels SPr, SPg, SPb representing the same color are connected with one data line DL as in the case shown in FIG. 8. In order to process image data of 4:4:4 format, the driving frequency of the display panel 110 is reduced by ½, and the data driving circuit 130 can sequentially transmit image data of one horizontal period (1H) to adjacent subpixels of the same color twice in one clock period of the driving frequency.

In FIG. 10, a first switch SW1 for transmitting RGB image data to the first pixel P1 and a second switch SW2 for transmitting RGB image data to the adjacent second pixel P2 are disposed on the data line DL between the data pad 139 and the sub-pixel SP. However, in case of FIG. 12, the display device has a structure configured as a double gate line GL structure in which two gate lines GL are arranged in one row, and controls the scan signals SCAN1 and SCAN2 applied to the first pixel P1 and the second pixel P2, so that the first pixel P1 and the second pixel P2 disposed adjacent to each other in the same row can be independently controlled. FIG. 12 also shows the scan signals SCAN3 and SCAN4 applied to two pixels in the next row of the first pixel P1 and the second pixel P2.

In this state, if the first scan signal SCANT applied to the first pixel P1 and the second scan signal SCAN2 applied to the second pixel P2 adjacent to the first pixel P1 are turned on at the same timing, the operation is substantially the same as that of the simplified panel structure of FIG. 8.

On the other hand, in the case that, while reducing the driving frequency of the display panel 110 by ½, the first scan signal SCANT applied to the first pixel P1 and the second scan signal SCAN2 applied to the second pixel P2 adjacent to the first pixel P1 are turned on once in one clock period of the driving frequency, image data of one horizontal period (1H) can be alternately transmitted twice to adjacent subpixels of the same color.

Figure 13:
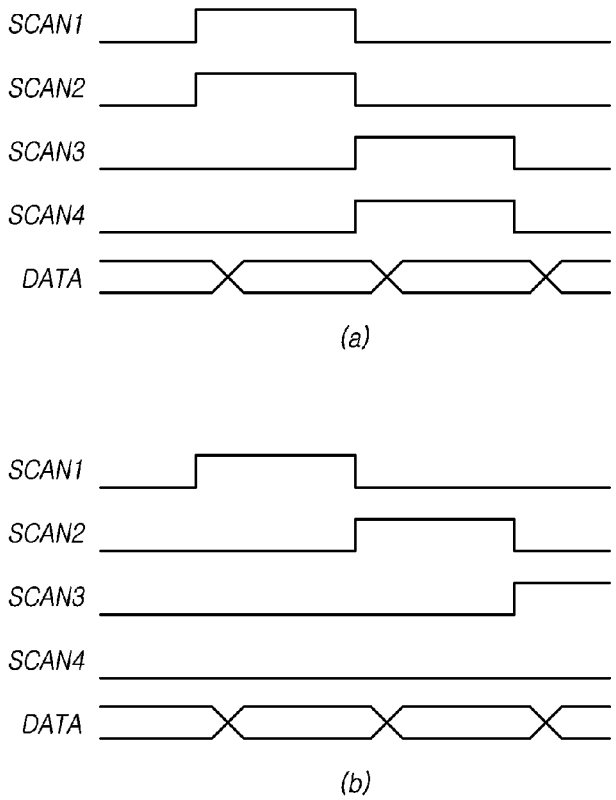
FIG. 13 is a diagram illustrating signal waveforms for processing image data of 4:2:2 format and image data of 4:4:4 format in a display device having a simplified panel structure according to another embodiment of the present disclosure.

FIG. 13 is a diagram illustrating signal waveforms for processing image data of 4:2:2 format and image data of 4:4:4 format in a display device having a simplified panel structure according to another embodiment of the present disclosure.

Referring to FIG. 13, in a display device 100 having the simplified panel structure of FIG. 12, when image data of 4:2:2 format is input, as for the first scan signal SCAN1 applied to the first pixel P1 and the second scan signal SCAN2 applied to the second pixel P2 adjacent to the first pixel P1, the turn-on and turn-off signals are applied together at the same timing (the case of (a) in FIG. 13).

In this case, the display device 100 having the simplified panel structure of FIG. 12 is substantially the same as the simplified panel structure of FIG. 8, and RGB image data among image data of the 4:2:2 format is simultaneously supplied to two adjacent RGB subpixels (SPr1 and SPr2, SPg1 and SPg2, SPb1 and SPb2) having the same color.

On the other hand, when image data of 4:4:4 format is input, the first scan signal SCANT applied to the first pixel P1 and the second scan signal SCAN2 applied to the second pixel P2 adjacent to the first pixel P1 are alternately switched, so that the horizontal period of the display panel 110 increases by two times and the driving frequency decreases by ½.

As a result, image data of one horizontal period (1H) in one clock period of the display panel 110 can be alternately transmitted to adjacent RGB subpixels (SPr1 and SPr2, SPg1 and SPg2, and SPb1 and SPb2) of the same color (the case of (b) in FIG. 13).

Accordingly, the display device 100 of the present disclosure can process the YCbCr image data or RGB image data to a WRGB image data even when image data of 4:4:4 format are input as well as image data of 4:2:2 format.

In addition, the display device 100 of the present disclosure can process the YCbCr image data to a WRGB image data even when YCbCr image data of 4:2:0 format are input.

Figure 14:
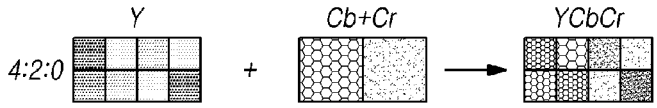
FIG. 14 is a diagram conceptually illustrating a process of converting YCbCr image data of 4:2:0 format into image data for display in a display device according to embodiments of the present disclosure.

FIG. 14 is a diagram conceptually illustrating a process of converting YCbCr image data of 4:2:0 format into image data for display in a display device according to embodiments of the present disclosure.

Referring to FIG. 14, in the case that YCbCr image data (image source) of 4:2:0 format is input to a display devices 100 according to embodiments of the present disclosure, YCbCr image data can include four luminance data (Y) and one color difference data (Cb and Cr) based on 2×2 pixels.

For example, in the YCbCr image data of 4:2:0 format, the luminance data (Y) has one value specified for each pixel, however, the color difference data (Cb and Cr) has the same value for four pixels of a square structure including two pixels adjacent in a row direction and two pixels adjacent in a column direction.

When YCbCr image data is received, the display device 100 of the present disclosure can first convert the received data into RGB image data corresponding to each pixel. In this case, the YCbCr image data can be converted into RGB image data by a host system inside the display device 100 or can be converted into RGB image data by a timing controller 140.

The RGB image data corresponding to each pixel can be expressed in a row and column in which the pixel is located. For example, $R_{11}G_{11}B_{11}$ can correspond to RGB image data corresponding to a pixel in 1 row and 1 column, and $R_{12}G_{12}B_{12}$ can correspond to RGB image data corresponding to a pixel in 1 row and 2 columns.

In this case, as for YCbCr image data of 4:2:0 format, the color difference data (Cb and Cr) has the same value for four pixels of a square structure including two pixels adjacent in a row direction and two pixels adjacent in a column direction. For example, all of a color difference data $Cb_{11}Cr_{11}$ corresponding to a pixel in 1 row and 1 column, a color difference data $Cb_{12}Cr_{12}$ corresponding to a pixel in 1 row and 2 columns, a color difference data $Cb_{21}Cr_{21}$ corresponding to a pixel in 2 rows and 1 column, and a color difference data $Cb_{22}Cr_{22}$ corresponding to a pixel in 2 rows and 2 columns can have the same value.

Accordingly, in the WRGB display device 100 of the present disclosure, the YCbCr image data can be displayed as WRGB image data by combining two adjacent RGB subpixels in a column direction to which image data is applied.

Figure 15:
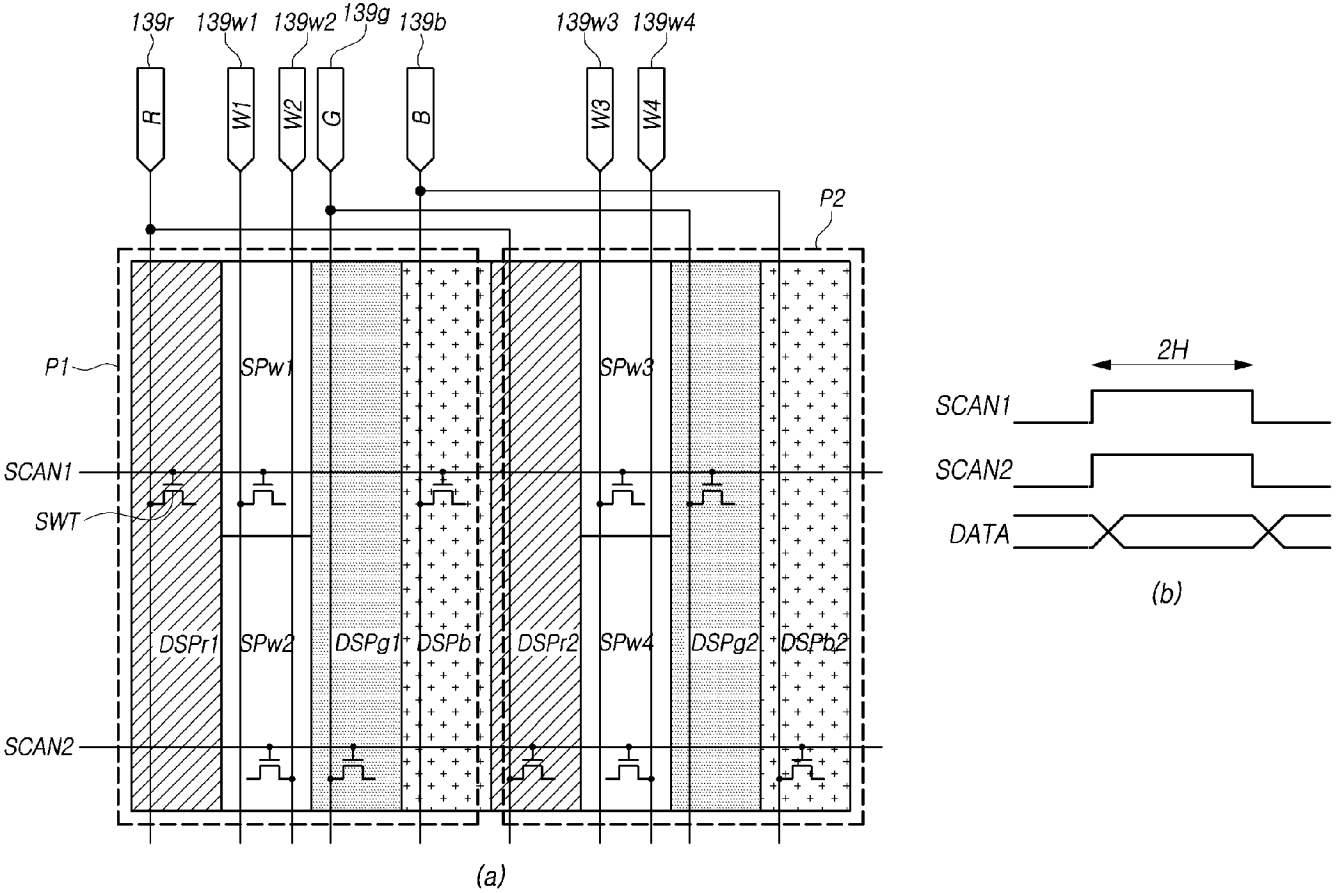
FIG. 15 is a diagram illustrating a structure and a signal waveform for processing image data of 4:2:0 format to WRGB image data in a display device according to embodiments of the present disclosure.

FIG. 15 is a diagram illustrating a structure and a signal waveform for processing image data of 4:2:0 format to WRGB image data in a display device according to embodiments of the present disclosure.

Referring to (a) of FIG. 15, in the first pixel P1, the display device 100 according to embodiments of the present disclosure can be configured so that two white subpixels SPw1, SPw2 are arranged in a column direction to which image data is applied, and RGB dual subpixels DSPr1, DSPg1, DSPb1 are arranged in sizes corresponding to the two white subpixels SPw1, SPw2 for the RGB subpixels in the column direction. Similar to the first pixel P1, in the second pixel P2, two white subpixels SPw3, SPw4 as well as RGB dual subpixels DSPr2, DSPg2, DSPb2 can be arranged. Two adjacent dual subpixels (DSPr1 and DSPr2, DSPg1 and DSPg2, DSPb1 and DSPb2) in a row direction representing the same color can be connected with one data line DL.

For example, as for TCbCr image data of 4:2:0 format, since the same data voltage is applied to two adjacent RGB subpixels having the same color in the column direction as well as the RGB subpixels having the same color in the row direction, the RGB subpixels is formed in a structure of dual subpixels DSPr1, DSPg1, DSPb1 having a size corresponding to the white subpixels SPw1, SPw2 adjacent in the column direction.

Therefore, dual subpixels DSPr1, DSPg1, DSPb1 are subpixels having a region including RGB subpixels of the same color adjacent to each other in a column direction among the smallest unit RGB subpixels, and can be considered as a subpixel having a size corresponding to the two white subpixels (SPw1 and SPw2) in the column direction.

Then, two adjacent dual subpixels (DSPr1 and DSPr2, DSPg1 and DSPg2, DSPb1 and DSPb2) having the same color in the row direction are connected with one data line DL, so that YCbCr image data of 4:2:0 format can be displayed as WRGB image data.

The white subpixels SPw1, SPw2 in the column direction are not formed in the size of the dual subpixels DSPr1, DSPg1, DSPb1 since the luminance data Y is individually applied. However, since only two RGB subpixels adjacent in the column direction are formed as dual subpixels DSPr1, DSPg1, DSPb1, it can be considered that two white subpixels SPw1, SPw2 arranged in the column direction and three dual subpixels DSPr1, DSPg1, DSPb1 form one pixel P1.

In this dual subpixel structure, two data lines corresponding to the first dual subpixel DSPr1 and the second dual subpixel DSPr2 of red color located adjacent to each other in the row direction are connected to one red data pad 139*r*, so that a data voltage corresponding to the same color component data can be applied to two dual subpixels DSPr1 and DSPr2 of red color adjacent in the row direction and the column direction.

Similarly, two data lines corresponding to the first dual subpixel DSPg1 and the second dual subpixel DSPg2 of green color located adjacent to each other in the row direction can be connected to one green data pad 139*g*, and two data lines corresponding to the first dual subpixel DSPb1 and the second dual subpixel DSPb2 of blue color located adjacent to each other in the row direction can be connected to one blue data pad 139*b*.

On the other hand, since the white subpixels SPw1 and SPw2 adjacent in the column direction can correspond to different luminance data Y in a state separated from each other, the data line corresponding to the first white subpixel SPw1 and the data line corresponding to the second white subpixel SPw2 are individually connected to different white data pads 139*w*1, 139*w*2, respectively.

Accordingly, in the dual RGB subpixel structure in which the adjacent RGB subpixels in the column direction are formed in a larger area than the white subpixels, since the same data voltage corresponding to one color component data is applied to two adjacent dual subpixels (DSPr1 and DSPr2, DSPg1 and DSPg2, DSPb1 and DSPb2) having the same color in the row direction, the dual subpixels DSPr1, DSPr2, DSPg1, DSPg2, DSPb1, DSPb2 having a square structure adjacent to each other in a row direction and a column direction can be simultaneously emitted so as to correspond to the image data of 4:2:0 format.

In this case, for eight columns of subpixels SP, the data voltage can be applied through four white data pads 139$w$1, 139$w$2, 139$w$3, 139$w$4 connected to four white sub-pixels SPw1, SPw2, SPw3, SPw4, respectively, and three RGB data pads 139$r$, 139$g$, 139$b$ connected to three pairs of dual RGB subpixels (DSPr1 and DSPr2, DSPg1 and DSPg2, DSPb1 and DSPb2).

Therefore, since seven data lines DL and data pads 139 are required based on the eight columns of subpixels SP, it is possible to simplify a structure of a latch circuits 131, 133, a digital-to-analog converter 135 and the output buffer 137 constituting the data driving circuit 130, and also reduce the number of data driving circuits 130 constituting the display panel 110.

In this case, since the RGB subpixels constitute dual RGB subpixels DSPr1, DSPg1, DSPb1 formed in a larger area than the white subpixel in the column direction, and the white subpixels SPw1, SPw2 are formed in a smaller area than the dual subpixels, a first scan signal SCAN1 can be applied based on the upper first white subpixel SPw1 and a second scan signal SCAN2 can be applied based on the lower second white subpixel SPw2.

In this case, a switching transistor SWT driving the dual RGB subpixels DSPr1, DSPg1, DSPb1, . . . can be arranged so that the first scan signal SCAN1 and the second scan signal SCAN2 are alternately applied in the row direction.

In this case, the first scan signal SCANT and the second scan signal SCAN2 can be simultaneously turned on and turned off with a time interval of 2 horizontal periods 2H (the case of (b) in FIG. 15).

In this way, when switching the first scan signal SCAN1 and the second scan signal SCAN2 at the same time, the driving time interval of the pixels constituting the display panel 110 can increase by 2 times, so that there is an advantage in that a time interval for charging the data line DL can be sufficiently secured.

As described above, the structure in which data lines DL corresponding to two dual subpixels of the same color adjacent in the row direction are connected to one data pad 139 can be referred as a simplified panel structure for the 4:2:0 format.

Figure 16:
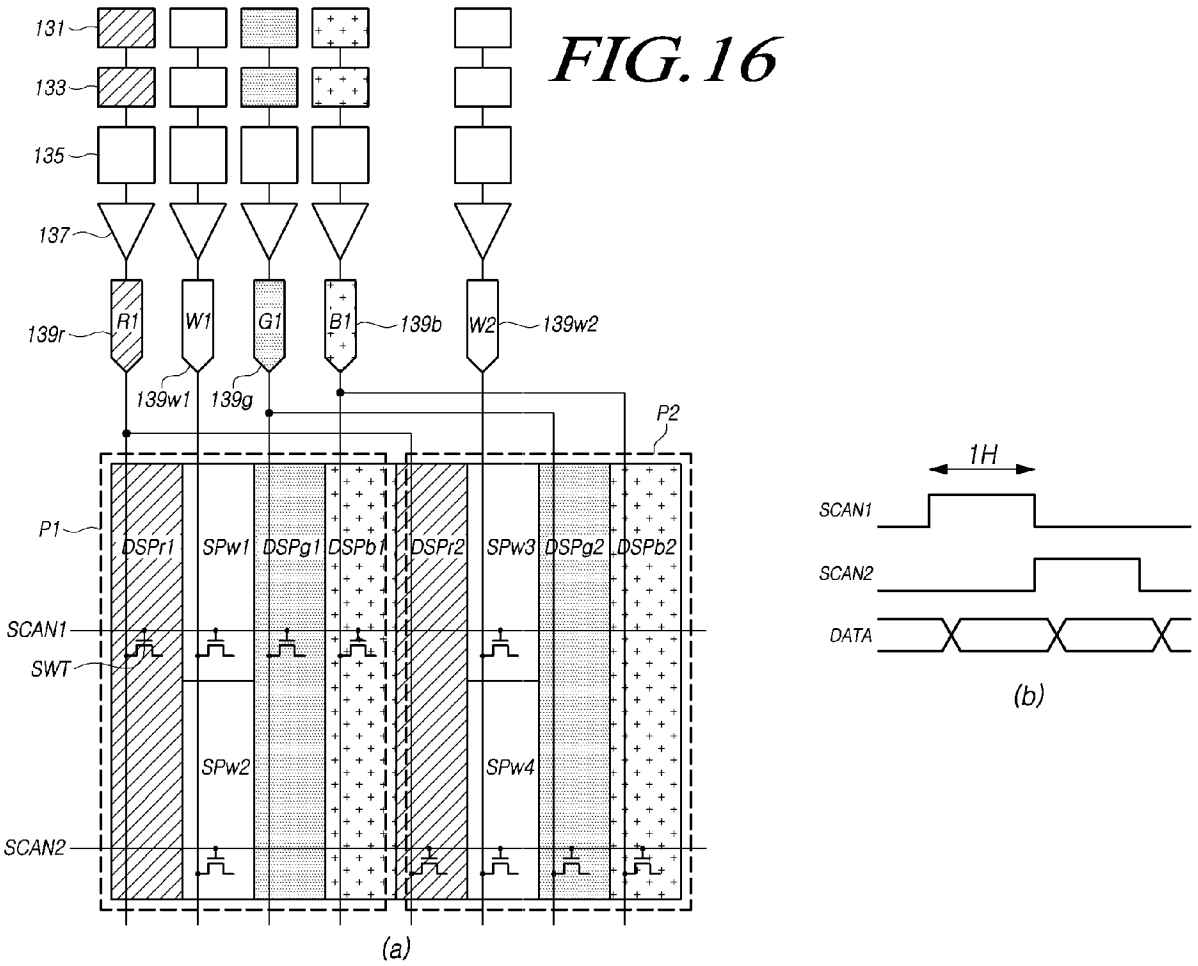
FIG. 16 is a diagram illustrating a structure and a signal waveform for processing image data of 4:2:0 format to WRGB image data in a display device having a simplified panel structure according to another embodiment of the present disclosure.

FIG. 16 is a diagram illustrating a structure and a signal waveform for processing image data of 4:2:0 format to WRGB image data in a display device having a simplified panel structure according to another embodiment of the present disclosure.

Referring to FIG. 16, in the display device 100 according to another embodiment of the present disclosure, two white subpixels SPw1 and SPw2 are arranged in a column direction to which image data is applied. However, as for RGB subpixels in the column direction, the display panel 110 is configured so that the RGB dual subpixels DSPr1, DSPg1, DSPb1 are arranged in a size corresponding to two white subpixels SPw1, SPw2, and two adjacent dual subpixels DSPr, DSPg, DSPb in a row direction representing the same color can be connected to one data line DL.

In this case, a switching transistor SWT driving the dual subpixels DSPr1, DSPg1, DSPb1 in the first pixel P1 can be connected to the same gate line GL to be simultaneously switched by the first scan signal SCAN1, and a switching transistor SWT driving the dual subpixels DSPr2, DSPg2, DSPb2 in the second pixel P2 adjacent in the row direction can be connected to the other gate line GL to be simultaneously switched by the second scan signal SCAN2.

In particular, driving times of the adjacent pixels P1 and P2 in the row direction can be controlled differently by alternately turning on and off the first scan signal SCAN1 and the second scan signal SCAN2.

In this case, two data lines corresponding to the first dual subpixel DSPr1 and the second dual subpixel DSPr2 of red color located adjacent to each other in the row direction can be connected to one red data pad 139$r$, so that the same data voltage corresponding to one color component data can be applied to two adjacent dual subpixels DSPr1 and DSPr2 in the row direction and the column direction.

Similarly, two data lines corresponding to the first dual subpixel DSPg1 and the second dual subpixel DSPg2 of green color located adjacent to each other in the row direction can be connected to one green data pad 139$g$, and two data lines corresponding to the first dual subpixel DSPb1 and the second dual subpixel DSPb2 of blue color located adjacent to each other in the row direction can be connected to one blue data pad 139$b$.

On the other hand, two white subpixels SPw1 and SPw2 adjacent in the column direction are connected together to a data line extending from one white data pad 139$w$1.

In this way, since the RGB dual subpixels DSPr1, DSPg1, DSPb1 are formed in a size corresponding to the two white subpixels SPw1, SPw2 arranged in the column direction, and the same data voltage corresponding to one color component data is applied to two dual subpixels (DSPr1 and DSPr2, DSPg1 and DSPg2, DSPb1 and DSPb2) having the same color and adjacent to each other in the row direction, the dual subpixels DSPr1, DSPr2, DSPg1, DSPg2, DSPb1, DSPb2 having a square structure adjacent to each other in a row direction and a column direction can be simultaneously emitted so as to correspond to the image data of 4:2:0 format.

In the case of this structure, for the eight subpixels SP arranged in the row direction, the data voltage can be applied through the white data pad 139$w$1 together connected to two white subpixels SPw1, SPw2, the white data pad 139$w$2 together connected to the other two white subpixels SPw3, SPw4, and three RGB data pads 139$r$, 139$g$, 139$b$ connected to three pairs (DSPr1 and DSPr2, DSPg1 and DSPg2, DSPb1 and DSPb2) of dual subpixels connected to each other of the same color.

Therefore, since five data lines DL and data pads 139 are required for the eight subpixels SP arranged in the row direction, it is possible to simplify a structure of a latch circuits 131, 133, a digital-to-analog converter 135 and the output buffer 137 constituting the data driving circuit 130, and also reduce the number of data driving circuits 130 constituting the display panel 110.

Figure 17:
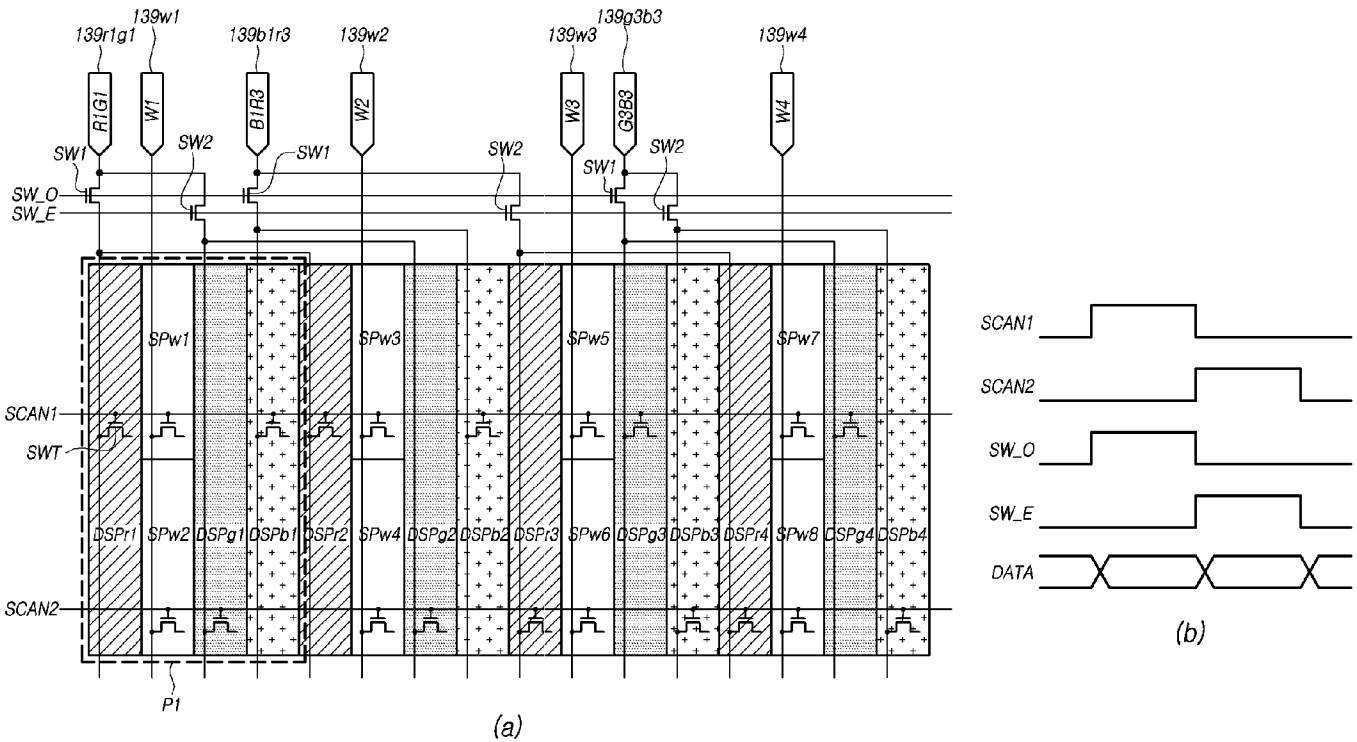
FIG. 17 is a diagram illustrating a structure of a display panel for processing image data of 4:2:0 format in a display device having a simplified panel structure according to another embodiment of the present disclosure.

FIG. 17 is a diagram illustrating a structure of a display panel for processing image data of 4:2:0 format in a display device having a simplified panel structure according to another embodiment of the present disclosure.

Referring to FIG. 17, in the display device 100 having a simplified panel structure according to another embodiment of the present disclosure, two white subpixels (e.g., SPw1 and SPw2) are arranged in a column direction to which image data is applied. However, for the RGB subpixels in the column direction, the display panel 110 is configured such that dual subpixels (e.g., DSPr1, DSPg1, and DSPb1) are arranged in sizes corresponding to the two white subpixels (e.g., SPw1 and SPw2).

However, in this case, two adjacent dual subpixels (e.g., DSPr1 and DSPr2, DSPg1 and DSPg2, DSPb1 and DSPb2) representing the same color are connected to a single data line DL, and two dual subpixels (e.g., DSPr1 and DSPg1, DSPb1 and DSPr3, DSPg3 and DSPb3) are additionally connected through switches SW1 and SW2.

Therefore, the data pads 139 except for the white data pad 139*w* can correspond to the dual data pads 139*r*1*g*1, 139*b*1*r*3, 139*g*3*b*3 capable of transmitting image data corresponding to two colors to the display panel 110. The position of the dual subpixels DSPr1, DSPr2, DSPr3, DSPr4, DSPg1, DSPg2, DSPg3, DSPg4, DSPb1, DSPb2, DSPb3, DSPb4 to which image data transmitted from the dual data pads 139*r*1*g*1, 139*b*1*r*3, 139*g*3*b*3 is transmitted can be controlled by the switches SW1 and SW2.

In this case, since two white subpixels SPw1 and SPw2 are arranged in the column direction, however, for the RGB subpixels, one dual subpixel DSPr1, DSPg1, or DSPb1 is arranged in a size corresponding to two white subpixels SPw1, SPw2, it can be considered that two white subpixels SPw1, SPw2 and three dual subpixels DSPr1, DSPg1, DSPb1 form one pixel P1.

Meanwhile, since the two white subpixels SPw1, SPw2 are arranged to correspond to one dual subpixel DSPr1, DSPg1, or DSPb1 in the column direction, the first scan signal SCAN1 applied based on the upper first white subpixel SPw1 and the second scan signal SCAN2 applied based on the lower second white subpixel SPw2 can be applied for one pixel P1.

In this case, in the display device 100 of the simplified panel structure, a first switch SW1 for transmitting RGB image data transmitted from the dual data pads 139*r*1*g*1, 139*b*1*r*3, 139*g*3*b*3 in response to the first scan signal SCAN1 and a second switch SW2 for transmitting RGB image data transmitted from the dual data pads 139*r*1*g*1, 139*b*1*r*3, 139*g*3*b*3 in response to the second scan signal SCAN2 can be disposed on the data line DL between the dual data pads 139*r*1*g*1, 139*b*1*r*3, 139*g*3*b*3 and the subpixel SP.

In this state, a first switching signal SW_O applied to the first switch SW1 to correspond to the first scan signal SCAN1 and a second switching signal SW_E applied to the second switch SW2 to correspond to the second scan signal SCAN2 is sequentially applied every one horizontal period (1H), so that RGB image data of one horizontal period (1H) can be alternately transferred to RGB subpixels of different colors.

In this structure, for 16 subpixels SP arranged in the row direction, the data voltage can be applied through four white data pads 139*w*1, 139*w*2, 139*w*3, 139*w*4 and three dual data pads 139*r*1*g*1, 139*b*1*r*3, 139*g*3*b*3 connected to three pairs of dual subpixels (e.g., DSPr1 and DSPg1, DSPb1 and DSPr3, DSPg3 and DSPb3) connected to adjacent RGB subpixels.

Accordingly, since seven data lines DL and data pads 139 are required for 16 subpixels SP arranged in a row direction, it is possible to simplify a structure of a latch circuits 131, 133, a digital-to-analog converter 135 and the output buffer 137 constituting the data driving circuit 130, and also reduce the number of data driving circuits 130 constituting the display panel 110.

The above description and the accompanying drawings provide an example of the technical idea of the present disclosure for illustrative purposes only. Those having ordinary knowledge in the technical field, to which the present disclosure pertains, will appreciate that various modifications and changes in form, such as combination, separation, substitution, and change of a configuration, are possible without departing from the essential features of the present disclosure. Therefore, the embodiments disclosed in the present disclosure are intended to illustrate the scope of the technical idea of the present disclosure, and the scope of the present disclosure is not limited by the embodiment. The scope of the present disclosure shall be construed on the basis of the accompanying claims in such a manner that all of the technical ideas included within the scope equivalent to the claims belong to the present disclosure.

What is claimed is:

1. A display device comprising:

a display panel in which a plurality of pixels including a first pixel including at least first, second and third subpixels and a second pixel including at least another first subpixel emitting a same color of light as the first subpixel, another second subpixel emitting a same color of light as the second subpixel, and another third subpixel emitting a same color of light as the third subpixel, which are disposed in a region where a plurality of gate lines extending in a first direction and a plurality of data lines extending in a second direction intersect;

a gate driving circuit configured to drive the plurality of gate lines;

a data driving circuit configured to drive the plurality of data lines; and a timing controller configured to control the gate driving circuit and the data driving circuit, wherein, in the display panel, while data voltages are supplied to the first and second pixels, different first data voltages are supplied to the first subpixel and the another first subpixel, and a same second data voltage is supplied to the second subpixel and the another second subpixel.

2. The display device of claim 1, wherein the display panel includes two second subpixels in a neighborhood with same color in the first direction that are connected to one data pad together and two third subpixels in a neighborhood with same color in the first direction that are connected to another data pad.

3. The display device of claim 2, wherein, in the display panel, two gate lines among the plurality of gate lines are arranged in one row in which the plurality of pixels are arranged, and two pixels adjacent to each other in the first direction are configured to be independently controlled through the two gate lines.

4. The display device of claim 3, wherein turn-on and turn-off signals are applied to the two gate lines at the same time when image data of 4:2:2 format is received, and turn-on signals are alternately applied to the two gate lines when image data of 4:4:4 format is received.

5. The display device of claim 2, wherein the display panel includes:

a first switch configured to transfer image data transmitted from the data pad to an odd-numbered pixel, and a second switch configured to transfer image data transmitted from the data pad to an even-numbered pixel.

6. The display device of claim 1, wherein each of the second subpixel and the third subpixel are respectively composed of dual subpixel corresponding to the sizes of two first subpixels arranged in the second direction, and two dual subpixels adjacent in the first direction are connected to one data line.

7. The display device of claim 6, wherein, in the display panel, a first scan signal and a second scan signal are applied based on the two first subpixels, a switching transistor is disposed so that the first scan signal and the second scan signal are alternately applied to the dual subpixels arranged in the first direction, and the first scan signal and the second scan signal are simultaneously turned on and turned off with a time interval of two horizontal periods.

8. The display device of claim 6, wherein, in the display panel, a first scan signal and a second scan signal are applied based on the two first subpixels, a switching transistor is disposed so that the corresponding to the first subpixel and the dual subpixel in a first pixel are simultaneously turned on by the first scan signal, a switching transistor is disposed so that the corresponding to the first subpixel and the dual subpixel in a second pixel adjacent to the first pixel in the first direction are simultaneously turned on by the second scan signal, and the first scan signal and the second scan signal are alternately turned on and turned off.

9. The display device of claim 1, wherein the first subpixel is a white subpixel.

10. The display device of claim 1, wherein the second and the third subpixels are selected subpixels from a group of a red subpixel, a green subpixel, and a blue subpixel.

11. The display device of claim 1, wherein the second and the third subpixels are adjacent in the first direction.

12. The display device of claim 1, wherein the timing controller is configured to convert YCbCr image data of 4:2:2 format, YCbCr image data of 4:2:0 format, YCbCr image data of 4:4:4 format or RGB image data, into image data for display.

13. The display device of claim 1, wherein the data driving circuit includes:

a plurality of first latch circuits configured to receive image data transmitted from the timing controller, and a plurality of second latch circuits configured to receive image data from one of the plurality of first latch circuits at a specified timing, and wherein the second latch circuit corresponding to the first subpixel is connected in a 1:1 manner to the corresponding first latch circuit, and two second latch circuits corresponding to two second subpixels in a neighborhood and two third subpixels in a neighborhood with same color in the first direction are connected to one first latch circuit among the plurality of first latch circuits.

14. The display device of claim 1, wherein the data driving circuit is configured to set a driving frequency of the display panel to a first frequency when image data of 4:2:2 format is received, and when image data of 4:4:4 format is received, the data driving circuit changes the driving frequency of the display panel to a second frequency lower than the first frequency and alternately transmits the image data to two second subpixels in a neighborhood and two third subpixels in a neighborhood with same color in the first direction in one clock period of the second frequency.

15. The display device of claim 1, wherein each of the second subpixel and the third subpixel are respectively composed of dual subpixels corresponding to the sizes of two first subpixels arranged in the second direction, two adjacent dual subpixels with same color and two adjacent dual subpixels with different colors in the first direction are connected to one dual data pad, and wherein the display panel further includes:

a first switch configured to transfer image data transmitted from the dual data pad to dual subpixels of a first color, and a second switch configured to transfer image data transmitted from the dual data pad to dual subpixels of a second color.

16. A data driving circuit for transferring image data to a display panel in which a plurality of pixels including a first subpixel, a second subpixel and a third subpixel are arranged in a matrix form, the data driving circuit comprising:

a plurality of first latch circuits configured to receive image data transmitted from a timing controller;

a plurality of second latch circuits each configured to receive image data from one of the plurality of first latch circuits at a specified timing;

a plurality of digital-to-analog converters configured to convert the image data of the plurality of second latch circuits into analog image data; and a plurality of output buffers configured to adjust an output level of the analog image data to supply to the display panel, wherein the second latch circuit corresponding to the first subpixel is connected in a 1:1 manner to the corresponding first latch circuit, two second latch circuits corresponding to two second subpixels in a neighborhood and two third subpixels in a neighborhood with same color in a first direction are connected to one first latch circuit among the plurality of first latch circuits, a luminance data voltage is supplied to the first subpixel, and a same data voltage is supplied to two second subpixels in a neighborhood or two third subpixels in a neighborhood with same color.

17. A display panel comprising:

a plurality of pixels including a first pixel including at least first, second and third subpixels and a second pixel including at least another first subpixel emitting a same color of light as the first subpixel, another second subpixel emitting a same color of light as the second subpixel, and another third subpixel emitting a same color of light as the third subpixel, which are arranged in a matrix form; and a plurality of data pads connecting respectively the second subpixel and the another second subpixel, and the third subpixel and the another third subpixel in a first direction, wherein while data voltages are supplied to the first and second pixels, different first data voltages are supplied to the first subpixel and the another first subpixel, and a same second data voltage is supplied to the second subpixel and the another second subpixel.

* * * * *